US009540088B1

(12) United States Patent
French

(10) Patent No.: US 9,540,088 B1
(45) Date of Patent: Jan. 10, 2017

(54) POWER STEERING CONTROL SYSTEM AND METHOD FOR AN OUTBOARD ENGINE OF A WATERCRAFT

(71) Applicant: BRP US INC., Sturtevant, WI (US)

(72) Inventor: Michael French, Pleasant Prairie, WI (US)

(73) Assignee: BRP US INC., Sturtevant, WI (US)

( * ) Notice: Subject to any disclaimer, the term of this patent is extended or adjusted under 35 U.S.C. 154(b) by 0 days.

(21) Appl. No.: 14/738,512

(22) Filed: Jun. 12, 2015

Related U.S. Application Data

(60) Provisional application No. 62/110,194, filed on Jan. 30, 2015.

(51) Int. Cl.
*B63H 20/12* (2006.01)

(52) U.S. Cl.
CPC ..... *B63H 20/12* (2013.01)

(58) Field of Classification Search
CPC ..... B63H 20/12
See application file for complete search history.

(56) References Cited

U.S. PATENT DOCUMENTS

| | | | | |
|---|---|---|---|---|
| 6,820,567 | B1 | 11/2004 | Kishi et al. | |
| 7,318,386 | B2 | 1/2008 | Dubra et al. | |
| 7,497,183 | B2 | 3/2009 | Dubra et al. | |
| 7,736,206 | B1 | 6/2010 | McChesney et al. | |
| 8,858,279 | B1 | 10/2014 | Wiatrowski et al. | |
| 2013/0138298 | A1* | 5/2013 | Derry | B62D 5/0481 701/42 |

* cited by examiner

*Primary Examiner* — Stephen Avila
(74) *Attorney, Agent, or Firm* — BCF LLP

(57) ABSTRACT

An outboard engine has a bracket. A drive unit mounted thereto is pivotable about a steering axis with respect thereto by a steering actuator. A motor operatively connected to the steering actuator is mounted to the bracket and rotationally fixed with respect thereto about the steering axis. A control module includes a motor drive electrically connected to the motor and configured to be connected to a power source. An electrically conductive thermal element is electrically connected to the motor. A temperature of the thermal element is indicative of a temperature of the motor. A controller is configured to obtain the temperature of the thermal element and to control power delivered to the motor via the motor drive based at least in part on the temperature of the thermal element. The controller and the thermal element are mounted to the drive unit and pivotable therewith about the steering axis.

19 Claims, 20 Drawing Sheets

POWER STEERING CONTROL SYSTEM AND METHOD FOR AN OUTBOARD ENGINE OF A WATERCRAFT

CROSS-REFERENCE

The present application claims priority to U.S. Provisional Patent Application No. 62/110,194 filed on Jan. 30, 2015, the entirety of which is incorporated herein by reference. The present application is related to U.S. Pat. No. 8,858,279 issued Oct. 14, 2014, U.S. Provisional Patent Application No. 61/491,561, filed May 31, 2011, U.S. Provisional Patent Application No. 61/591,429, filed Jan. 27, 2012, U.S. Provisional Patent Application No. 61/931,981, filed Jan. 27, 2014, and U.S. patent application Ser. No. 14/606,636, filed Jan. 27, 2015, the entirety of all of which is incorporated herein by reference.

TECHNICAL FIELD

The present technology relates to a power steering control system and method for outboard engines.

BACKGROUND

An outboard engine generally comprises a bracket assembly that connects the drive unit of the outboard engine to the transom of a boat. The drive unit includes the internal combustion engine and propeller. The outboard engine is typically designed so that the steering angle and the tilt/trim angles of the drive unit relative to the boat can be adjusted and modified as desired. The bracket assembly typically includes a swivel bracket carrying the drive unit for pivotal movement about a steering axis and a stern bracket supporting the swivel bracket and the drive unit for pivotal movement about a tilt axis extending generally horizontally. The stern bracket is connected to the transom of the boat.

A hydraulic actuator is connected between the swivel bracket and the drive unit for pivoting the drive unit about the steering axis in order to steer the boat. One or more hydraulic actuators are also connected between the stern and swivel brackets for pivoting the swivel bracket to trim the drive unit, to lift the lower portion of the outboard engine above the water level or, conversely, lower the lower portion of the outboard engine below the water level.

The steering motion of the watercraft is controlled by a steering assembly including a steering operator, such as a steering wheel, provided in the watercraft. The steering operator is connected to the hydraulic actuator(s) for steering via a hydraulic assembly including one or more pumps, hydraulic fluid reservoirs, hoses and valves. A power steering assembly is connected to the hydraulic assembly to assist in steering of the watercraft by the steering operator. It is possible for components of the power steering assembly to get overheated during operation of the watercraft.

It is known to protect electric components such as the power steering pump motor from overheating by providing a temperature sensor to monitor the temperature of the pump motor and shutting off the pump motor when the motor reaches a threshold operating temperature. However, abruptly shutting off the power steering pump during operation is undesirable as it will result in a sudden loss of power steering. In such a condition, the operator maintains the ability to steer the watercraft, but steering takes much more effort without the assistance provided by the power steering. Moreover, the sudden change in effort required to steer could potentially lead an operator of the watercraft to believe that their steering system of the watercraft has failed and/or cause a momentary loss of control of the watercraft. It is therefore desirable to prevent the power steering from abruptly shutting off when the pump motor reaches the threshold operating temperature.

It is therefore desirable to protect the components of the power steering assembly from overheating without compromising on the safety and functionality of the steering function, and without increasing the cost and/or complexity of components of the outboard engine.

SUMMARY

It is an object of the present technology to ameliorate at least some of the inconveniences present in the prior art.

According to one aspect of the present technology, there is provided an outboard engine for a watercraft having a bracket configured to be mounted to the watercraft, and a drive unit pivotally mounted to the bracket. The drive unit is pivotable about a steering axis with respect to the bracket. A steering actuator is operatively connected to the bracket and the drive unit for pivoting the drive unit with respect to the bracket about the steering axis. A motor is operatively connected to the steering actuator for actuating the steering actuator. The motor is mounted to the bracket and rotationally fixed with respect to the bracket about the steering axis. A power steering control module includes a motor drive electrically connected to the motor and configured to be electrically connected to a power source for delivering power to the motor. An electrically conductive thermal element is electrically connected to the motor, a temperature of the thermal element being indicative of a temperature of the motor. A controller is in communication with the motor drive for controlling power delivered to the motor via the motor drive. The controller is configured to obtain the temperature of the thermal element and to control power delivered to the motor based at least in part on the temperature of the thermal element. The controller and the thermal element are mounted to the drive unit and pivotable with the drive unit about the steering axis.

According to another aspect of the present technology, there is provided a watercraft including a hull, a deck disposed on the hull, a steering assembly disposed on the deck and including a steering operator, and an outboard engine according to the above aspect. The bracket is mounted to the hull, and the steering operator is operatively connected to the steering actuator for steering the watercraft.

According to another aspect of the present technology, there is provided a method for controlling an outboard engine having a bracket mounted to a watercraft and a drive unit pivotably connected to the bracket about a steering axis. The method includes providing electrical power to a motor for actuating a steering actuator of the outboard engine, the motor being mounted to the bracket and rotationally fixed with respect to bracket about the steering axis. A temperature of a thermal element electrically connected to the motor is sensed. The thermal element is fixed with respect to the drive unit, and the sensed temperature of the thermal element is indicative of a temperature of the motor. A duty cycle of the motor is controlled based at least in part on the sensed temperature of the thermal element.

For purposes of this application, the terms related to spatial orientation such as forward, rearward, left, right, vertical, and horizontal are as they would normally be understood by a driver of a watercraft sitting thereon in a normal driving position with an outboard engine mounted to a transom of the watercraft.

Definitions of terms provided herein take precedence over definitions of terms provided in any of the documents incorporated herein by reference.

Implementations of the present technology each have at least one of the above-mentioned aspects, but do not necessarily have all of them. It should be understood that some aspects of the present technology that have resulted from attempting to attain the above-mentioned object may not satisfy this object and/or may satisfy other objects not specifically recited herein.

Additional and/or alternative features, aspects, and advantages of implementations of the present technology will become apparent from the following description, the accompanying drawings, and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

DETAILED DESCRIPTION

Figure 1:
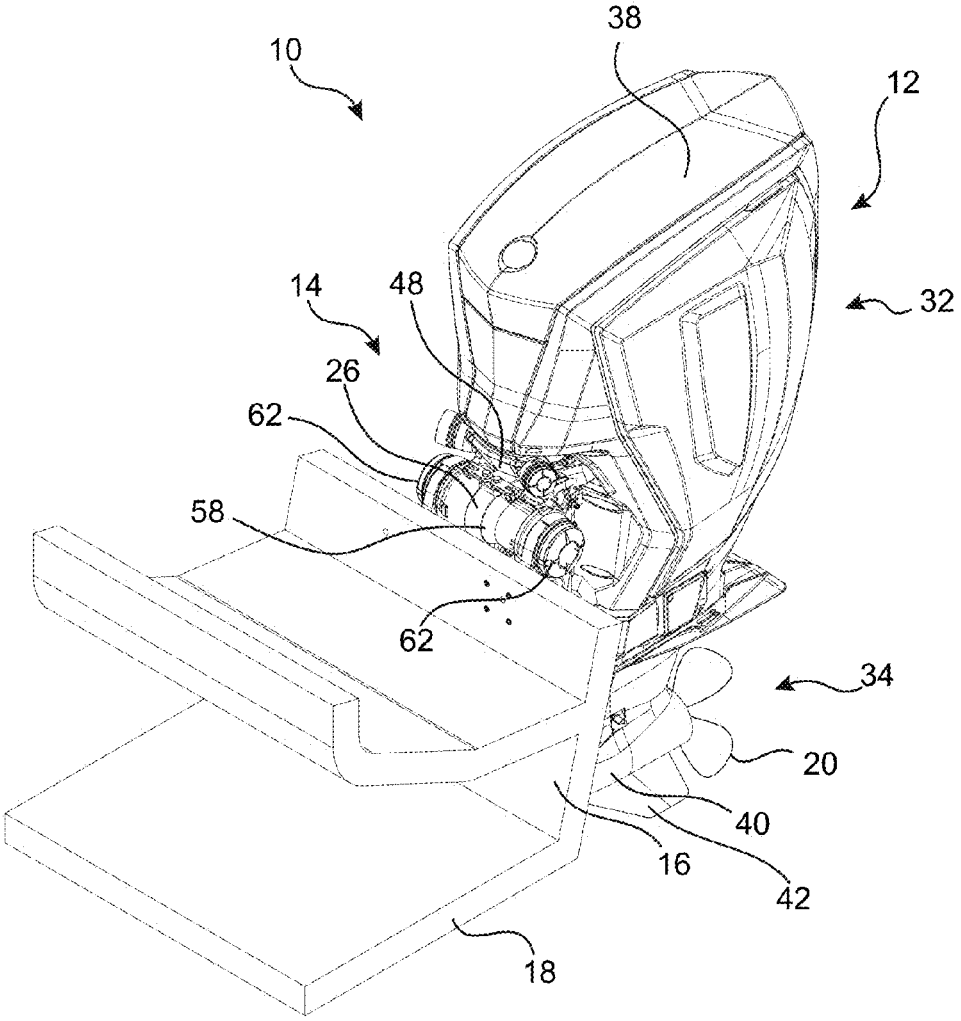
FIG. 1 is a perspective view taken from a front, left side of an outboard engine mounted in an upright position to a transom of watercraft.
Figure 2:
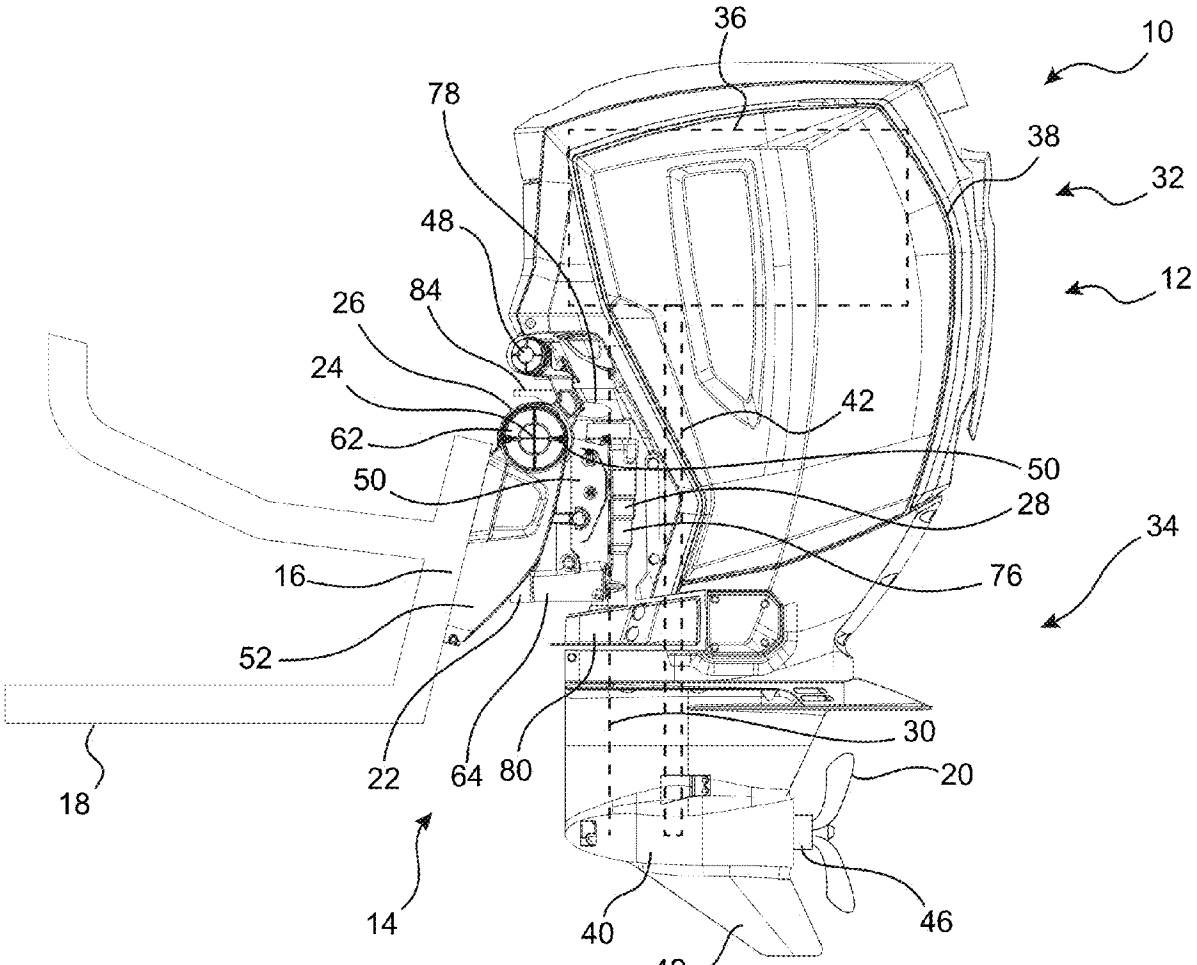
FIG. 2 is a left side elevation view of the outboard engine of FIG. 1.
Figure 3:
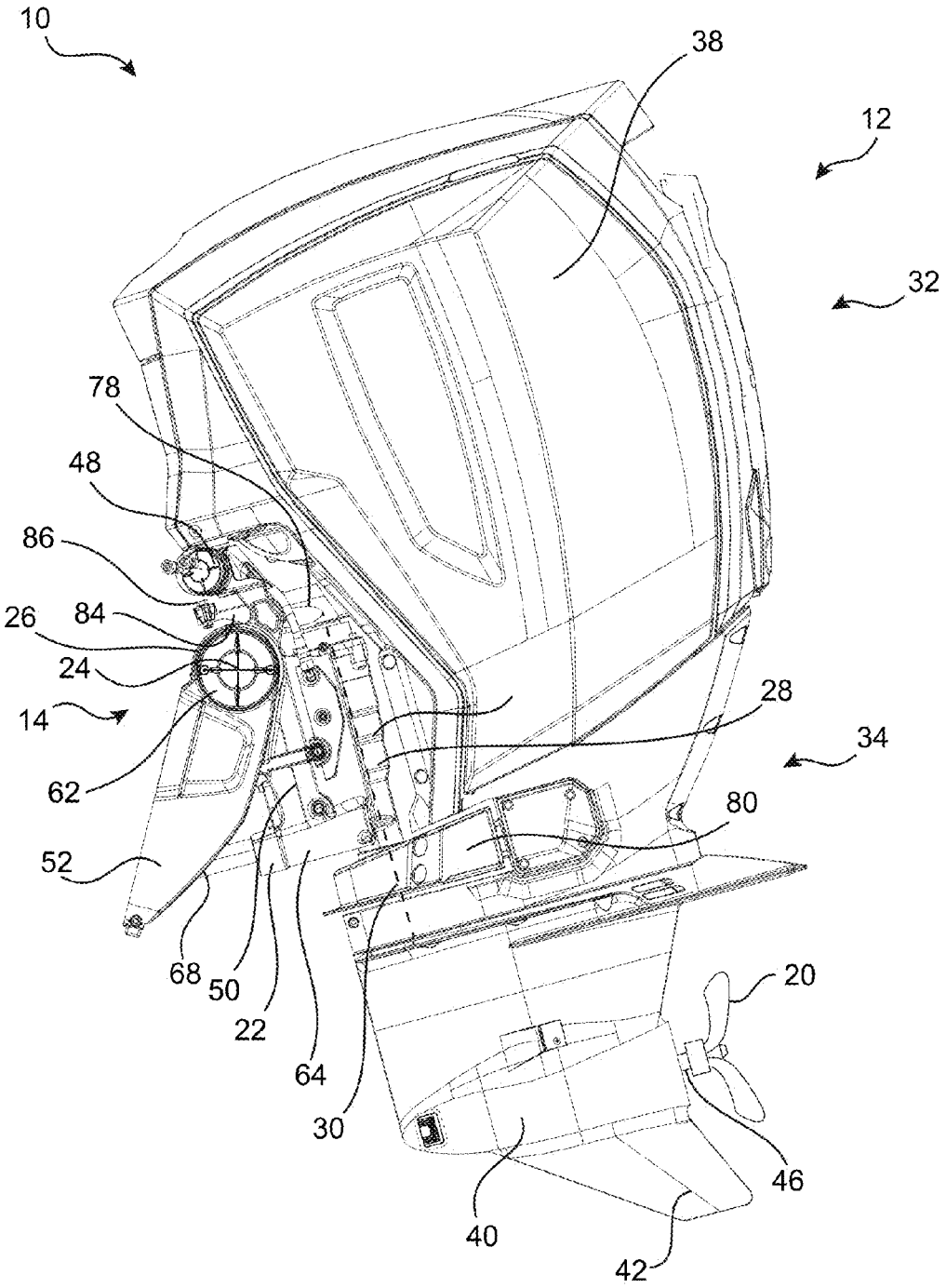
FIG. 3 is a left side elevation view of the outboard engine of FIG. 1 in a trim up position.
Figure 4:
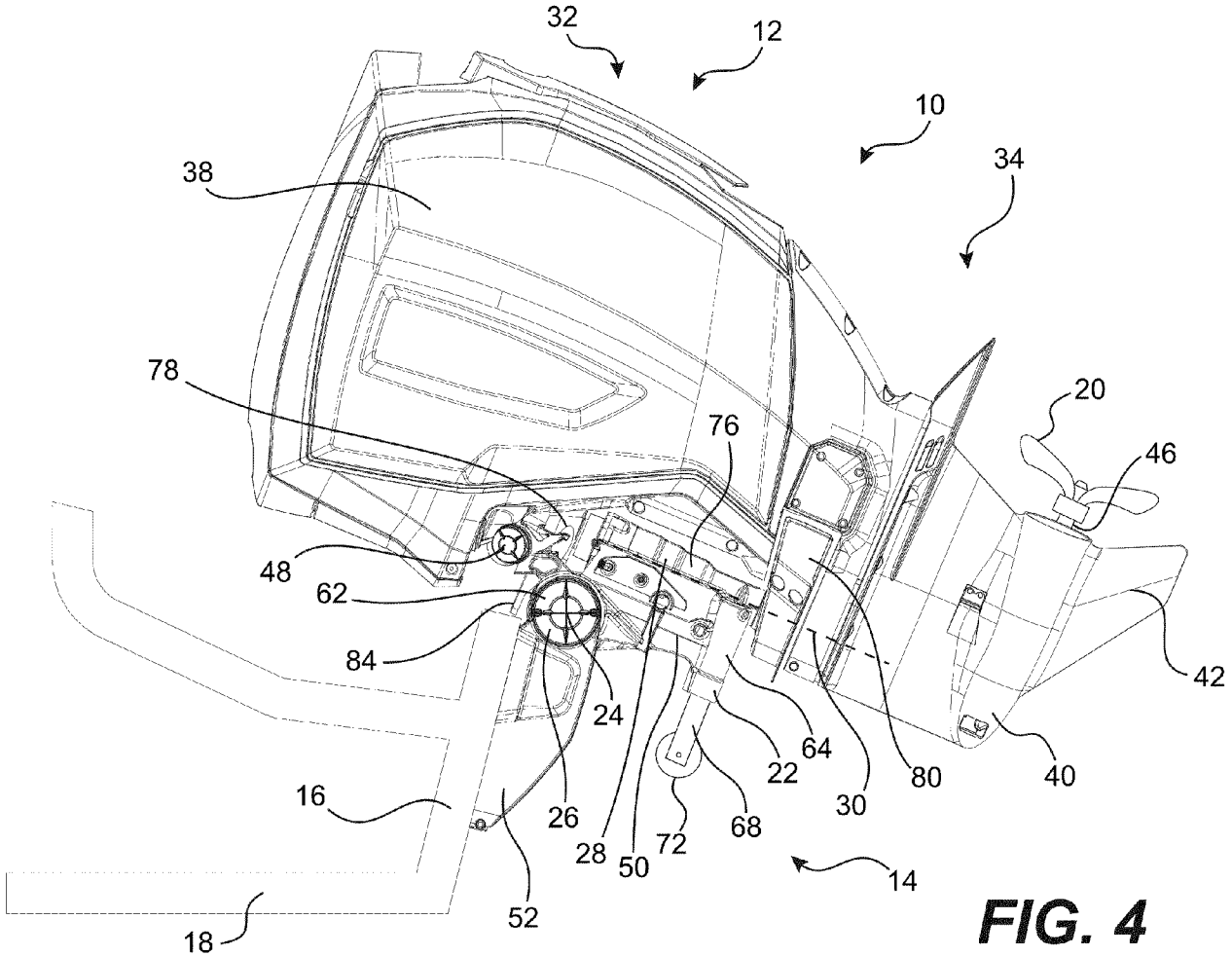
FIG. 4 is a left side elevation view of the outboard engine of FIG. 1 in a tilt up position.
Figure 5:
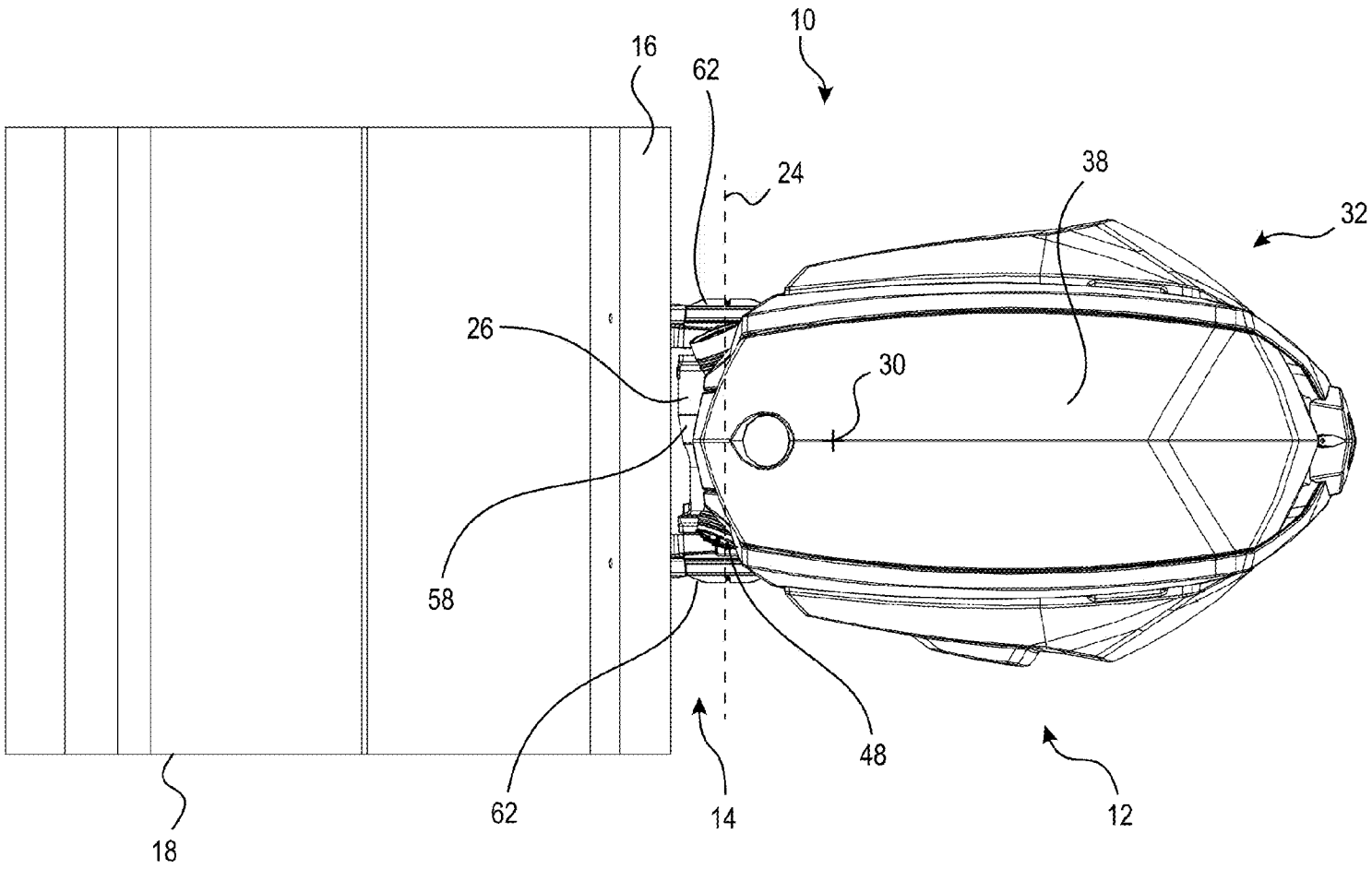
FIG. 5 is a top plan view of the outboard engine of FIG. 1 steered in a straight ahead direction.
Figure 6:
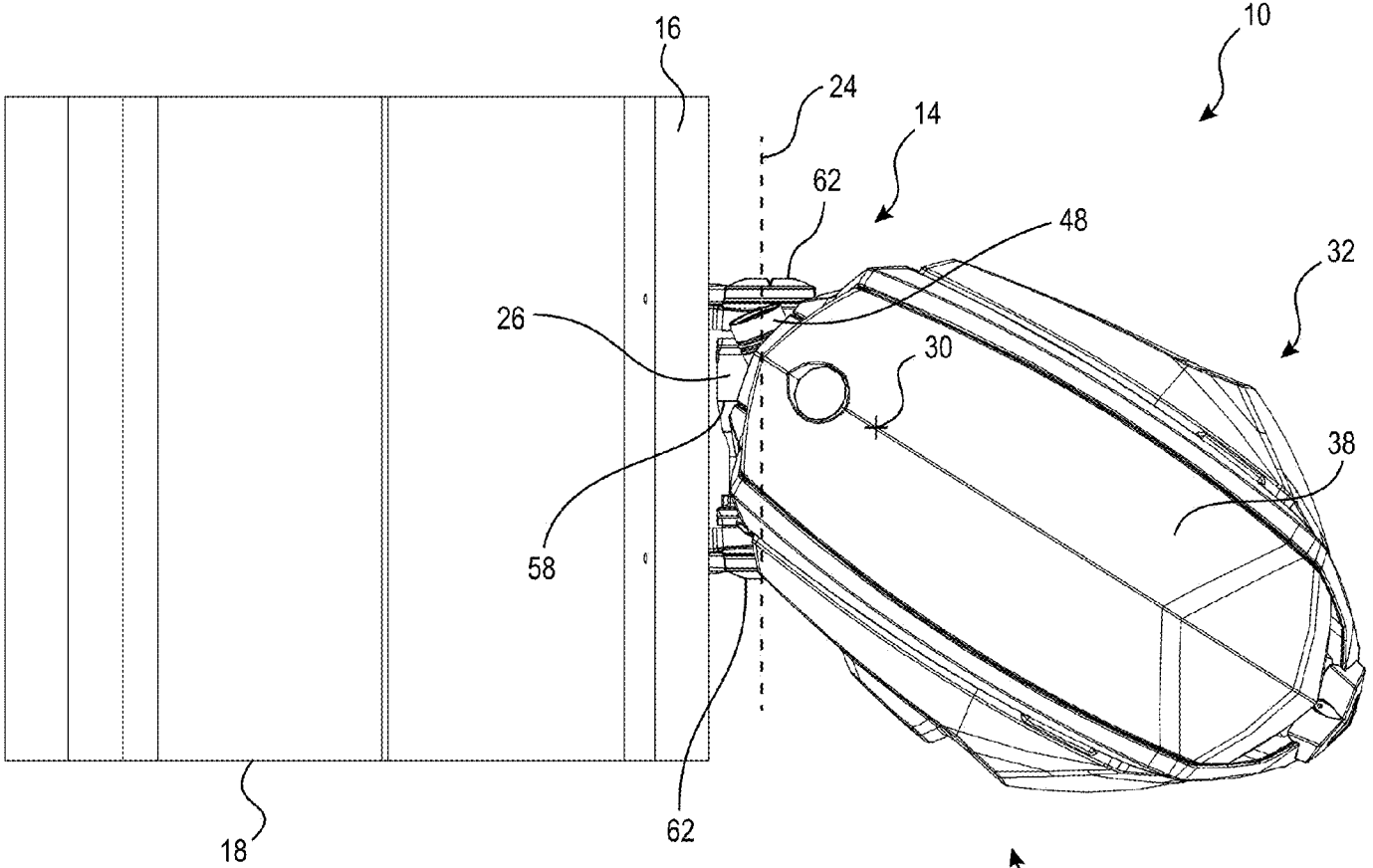
FIG. 6 is a top plan view of the outboard engine of FIG. 1 steered to make a left turn.

With reference to FIGS. 1 and 2, an outboard engine 10, shown in the upright position, includes a drive unit 12 and a bracket assembly 14. The bracket assembly 14 supports the drive unit 12 on a transom 16 of a hull 18 of an associated watercraft (not shown) such that a propeller 20 is in a submerged position with the watercraft resting relative to a surface of a body of water. The drive unit 12 can be trimmed up (see FIG. 3) or down relative to the hull 18 by linear actuators 22 of the bracket assembly 14 about a tilt/trim axis 24 extending generally horizontally. The drive unit 12 can also be tilted up (see FIG. 4) or down relative to the hull 18 by a rotary actuator 26 of the bracket assembly 14 about the tilt/trim axis 24. The drive unit 12 can also be steered left (see FIG. 6) or right relative to the hull 18 by another rotary actuator 28 of the bracket assembly 14 about a steering axis 30. The steering axis 30 extends generally perpendicularly to the tilt/trim axis 24. When the drive unit 12 is in the upright position as shown in FIGS. 1 and 2, the steering axis 30 extends generally vertically.

In the illustrated implementation, the actuators 22, 26 and 28 are hydraulic actuators. It is however contemplated that aspects of the technology could be applied to actuator other than hydraulic actuators.

The drive unit 12 includes an upper portion 32 and a lower portion 34. The upper portion 32 includes an engine 36 (schematically shown in dotted lines in FIG. 2) surrounded and protected by a cowling 38, also called an engine cover. The engine 36 housed within the cowling 38 is an internal combustion engine, such as a two-stroke or four-stroke engine, having cylinders extending horizontally. It is contemplated that other types of engine could be used and that the cylinders could be oriented differently. The lower portion 34 includes the gear case assembly 40, which includes the propeller 20, and the skeg portion 42.

The engine 36 is coupled to a driveshaft 44 (schematically shown in dotted lines in FIG. 2). When the drive unit 12 is in the upright position as shown in FIG. 2, the driveshaft 44 is oriented vertically. It is contemplated that the driveshaft 44 could be oriented differently relative to the engine 34. The driveshaft 44 is coupled to a drive mechanism (not shown), which includes a transmission (not shown) and the propeller 20 mounted on a propeller shaft 46. In FIG. 2, the propeller shaft 46 is perpendicular to the driveshaft 44, however it is contemplated that it could be at other angles. The driveshaft 44 and the drive mechanism transfer the power of the engine 36 to the propeller 20 mounted on the rear side of the gear case assembly 40 of the drive unit 12. It is contemplated that the propulsion system of the outboard engine 10 could alternatively include a jet propulsion device, turbine or other known propelling device. It is further contemplated that the bladed rotor could alternatively be an impeller.

To facilitate the installation of the outboard engine 10 on the watercraft, the outboard engine 10 is provided with a box 48. The box 48 is mounted on top of the rotary actuator 26, and thereby to the swivel bracket 50. As a result, the box 48 pivots about the tilt/trim axis 24 when the outboard engine 10 is tilted, but does not pivot about the steering axis 30 when the outboard engine 10 is steered. It is contemplated that the box 48 could be mounted elsewhere on the bracket assembly 14 or on the drive unit 12. Devices enclosed by the cowling 38 which need to be connected to other devices disposed externally of the outboard engine 10, such as on the deck or hull 18 of the watercraft, are provided with lines which extend inside the box 48. In one implementation, these lines are installed in and routed to the box 48 by the manufacturer of the outboard engine 10 during manufacturing of the outboard engine 10. Similarly, the corresponding devices disposed externally of the outboard engine 10 are also provided with lines that extend inside the box 48 where they are connected with their corresponding lines from the outboard engine 10. It is contemplated that one or more lines could be connected between one or more devices enclosed by the cowling 38 to one or more devices located externally of the outboard engine 10 and simply pass through the box 48. In such an implementation, the box 48 would reduce movement of the one or more lines when the outboard engine 10 is steered, tilted or trimmed.

Other known components of an engine assembly are included within the cowling 38, such as a starter motor, an alternator and the exhaust system. As it is believed that these components would be readily recognized by one of ordinary skill in the art, further explanation and description of these components will not be provided herein.

Turning now to FIGS. 7 to 14, the bracket assembly 14 will be described in more detail. The bracket assembly 14 includes a swivel bracket 50 pivotally connected to a stern bracket 52 via the rotary actuator 26. The stern bracket 52 includes a plurality of holes 54 and slots 56 adapted to receive fasteners (not shown) used to fasten the bracket assembly 14 to the transom 16 of the watercraft. By providing many holes 54 and slots 56, the vertical position of the stern bracket 52, and therefore the bracket assembly 14, relative to the transom 16 can be adjusted.

The rotary actuator 26 includes a cylindrical main body 58, a central shaft (not shown) disposed inside the main body 58 and protruding from the ends thereof, and a piston (not shown) surrounding the central shaft and disposed inside the main body 58. The main body 58 is located at an upper end of the swivel bracket 50 and is integrally formed therewith. It is contemplated that the main body 58 could be fastened, welded, or otherwise connected to the swivel bracket 50. The central shaft is coaxial with the tilt/trim axis 24. Splined disks 60 (FIG. 9) are provided over the portions of the central shaft that protrude from the main body 58. The splined disks 60 are connected to the central shaft so as to be rotationally fixed relative to the central shaft of the rotary actuator 26. The stern bracket 52 has splined openings at the upper end thereof that receive the splined disks 60 therein. As a result, the stern bracket 52, the splined disks 60 and the central shaft are all rotationally fixed relative to each other. Anchoring end portions 62 are fastened to the sides of the stern bracket 52 over the splined openings thereof and the ends of the central shaft, thus preventing lateral displacement of the swivel bracket 50 relative to the stern bracket 52.

The piston of the rotary actuator 26 is engaged to the central shaft thereof via oblique spline teeth on the central shaft and matching splines on the inside diameter of the piston. The rotary actuator piston is slidably engaged to the inside wall of the cylindrical main body 58 via longitudinal splined teeth on the outer diameter of the piston and matching splines on the inside diameter of the main body 58. When pressure is applied on the piston by supplying hydraulic fluid inside the main body 58 on one side of the piston, the piston slides along the central shaft. Since the central shaft is rotationally fixed relative to the stern bracket 52, the oblique spline teeth cause the piston, and therefore the main body 58 (due to the longitudinal spline teeth), to pivot about the central shaft and the tilt/trim axis 24. The connection between the main body 58 and the swivel bracket 50 causes the swivel bracket 50 to pivot about the tilt/trim axis 24 together with the main body 58. Supplying hydraulic fluid to one side of the piston causes the swivel bracket 50 to pivot away from the stern bracket 52 (i.e. tilt up). Supplying hydraulic fluid to the other side of the piston causes the swivel bracket 50 to pivot toward the stern bracket 52 (i.e. tilt down). In the present implementation, supplying hydraulic fluid to the left side of the piston causes the swivel bracket 50 to tilt up and supplying hydraulic fluid to the ride side of the piston causes the swivel bracket 50 to tilt down.

U.S. Pat. No. 7,736,206 B1, issued Jun. 15, 2010, the entirety of which is incorporated herein by reference, provides additional details regarding rotary actuators similar in construction to the rotary actuator 26. It is contemplated that the rotary actuator 26 could be replaced by a linear hydraulic actuator connected between the swivel bracket 50 and the stern bracket 52.

To maintain the swivel bracket 50 in a half-tilt position (i.e. a position intermediate the positions shown in FIGS. 2 and 4), which is a position of the swivel bracket 50 typically used when the watercraft is in storage or on a trailer, the bracket assembly 14 is provided with a locking arm 63 pivotally connected to the swivel bracket 50. To use the locking arm 63, the swivel bracket 50 is tilted up slightly past the half-tilt position, the locking arm 63 is pivoted to its locking position, and the swivel bracket 50 is tilted down to the half-tilt position where the locking arm 63 makes contact with the stern bracket 52. The locking arm 63 thus alleviates stress on the rotary actuator 26 and its associated hydraulic components during storage or transport on a trailer.

Figure 9:
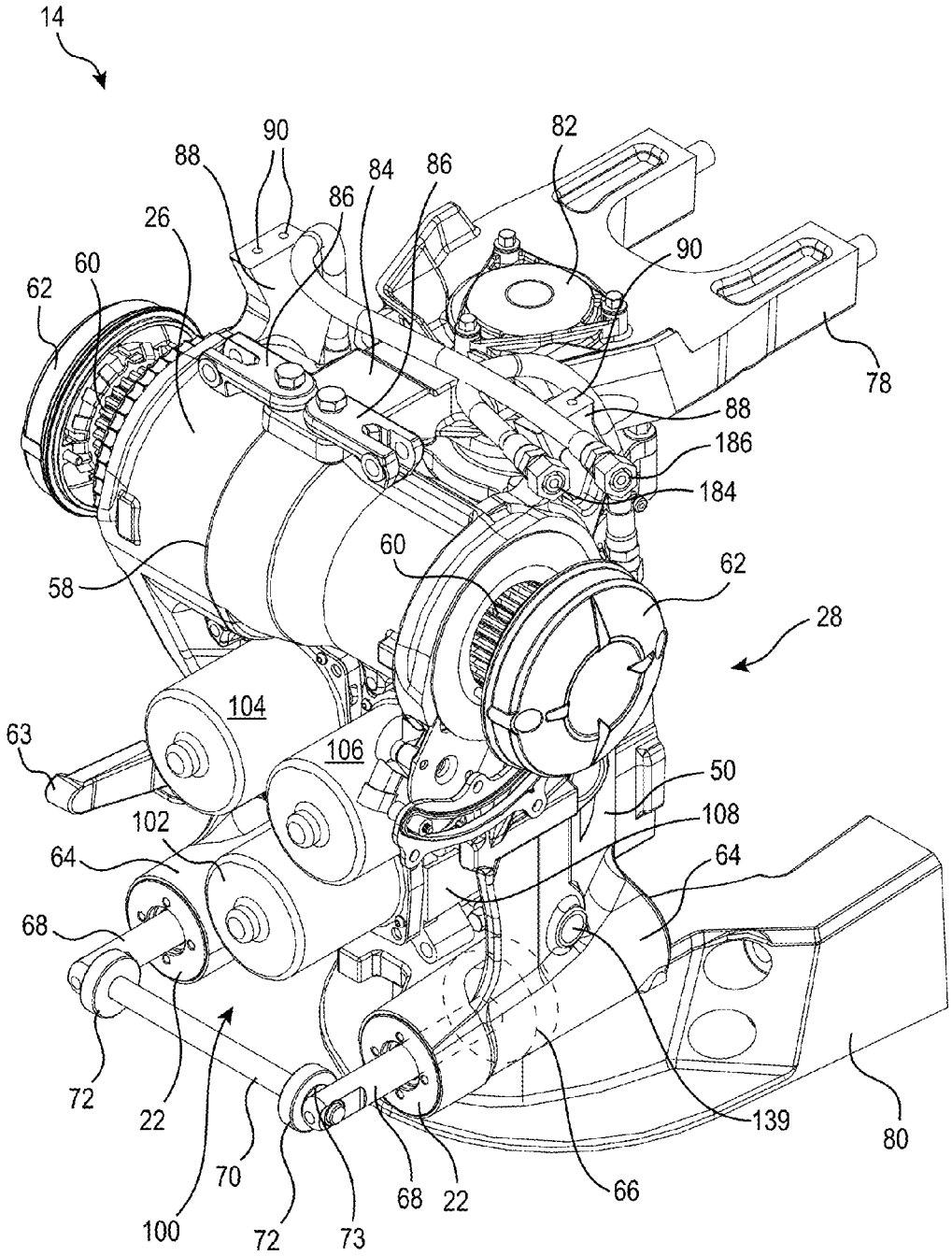
FIG. 9 is a perspective view taken from a front, left side of the bracket assembly of FIG. 7 with the stern bracket removed.

As best seen in FIG. 9, the linear actuators 22 each include a cylinder 64, a piston 66 (only the left piston 66 is shown in dotted lines in FIG. 9) disposed inside the cylinder 64, and a rod 68 connected to the piston 66 and protruding from the cylinder 64. As can be seen, the cylinders 64 are located at a lower end of the swivel bracket 50. The cylinders 64 are integrally formed with the swivel bracket 50 and the lines which supply them with hydraulic fluid are formed thereby. It is contemplated that the cylinders 64 could alternatively be fastened, welded, or otherwise connected to the swivel bracket 50. The rods 68 extend generally perpendicularly to the tilt/trim axis 24 and to the steering axis 30. It is contemplated that the hydraulic linear actuators 22 could be replaced by other types of linear actuators having a fixed portion connected to the swivel bracket 50 and a movable portion being extendable and retractable linearly relative to the fixed portion.

A shaft 70 extends from the left rod 68 to the right rod 68. The shaft 70 has a left roller 72 mounted adjacent to the left rod 68 and a right roller mounted adjacent to the right rod 68. The rollers 72 are made of stainless steel, but other materials, such as plastics, are contemplated. As best seen in FIG. 9, each of the left and right ends of the shaft 70 is inserted inside an aperture in the end portion of the corresponding rod 68 and rotatable therein. The rollers 72 are press-fit onto the shaft 70 so as to rotate with the shaft 70. It is contemplated that the rollers 72 could be rotationally fixed to the shaft 70 by other types of connections. For example, the rollers 72 could be welded, fastened or splined onto the shaft 70. In an alternative implementation, the shaft 70 is rotationally fixed relative to the rods 68 by being welded, fastened or otherwise connected thereto, and the rollers 72 are rotatably mounted onto the shaft 70 with bearings or bushings for example. Other structures of the shafts 68, rod 70 and rollers 72 are contemplated.

By supplying hydraulic fluid inside the cylinders 64 on the side of the pistons 66 opposite the side from which the rods 68 extend, the pistons 66 slide inside the cylinders 64. This causes the rods 68 to extend further from the cylinders 64 and the rollers 72 to roll along and push against the curved surfaces 74 (FIG. 7) formed by the ramps 75 connected to the stern bracket 52. The shaft 70 helps maintain the rollers 72 in alignment with each other. As the rollers 72 roll down along the curved surfaces 74, they move away from the stern bracket 52 due to the profile of the surfaces 74. As a result of the rods 68 extending from the cylinders 64 and the rollers 72 rolling along the surfaces 74, the swivel bracket 50 pivots away from the stern bracket 52 (i.e. trims up) about the tilt/trim axis 24 up to the angle shown in FIG. 3 where the rods 68 are fully extended. The profile of the curved surfaces 74 determines the speed at which the swivel bracket 50 pivots about the tilt/trim axis 24 (trim speed) for a given amount of extension of the rods 68.

Similarly to the rotary actuator 26, the rotary actuator 28 includes a cylindrical main body 76, a central shaft (not shown) disposed inside the main body 76 and protruding from the ends thereof, and a piston (not shown) surrounding the central shaft and disposed inside the main body 76. The main body 76 is centrally located along the swivel bracket 50 and is integrally formed therewith. It is contemplated that the main body 76 could be fastened, welded, or otherwise connected to the swivel bracket 50. The central shaft is coaxial with the steering axis 30. Splined disks (not shown) are provided over the portions of the central shaft that protrude from the main body 76. The splined disks are connected to the central shaft so as to be rotationally fixed relative to the central shaft. An upper generally U-shaped drive unit mounting bracket 78 has a splined opening therein that receives the upper splined disk therein. Similarly, a lower generally U-shaped drive unit mounting bracket 80 has a splined opening therein that receives the lower splined disk therein. The upper and lower drive unit mounting brackets 78, 80 are fastened to the drive unit 12 so as to support the drive unit 12 onto the bracket assembly 14. As a result, the drive unit 12, the splined disks and the central shaft are all rotationally fixed relative to each other. Anchoring end portions 82 (only the upper one of which is shown) are fastened to the upper and lower drive unit mounting brackets 78, 80 over the splined openings thereof and the ends of the central shaft, thus preventing displacement of the drive unit 12 along the steering axis 30.

The piston of the rotary actuator 28 is engaged to the central shaft via oblique spline teeth on the central shaft and matching splines on the inside diameter of the piston. The piston is slidably engaged to the inside wall of the cylindrical main body 76 via longitudinal splined teeth on the outer diameter of the piston and matching splines on the inside diameter of the main body 76. By applying pressure on the piston, by supplying hydraulic fluid inside the main body 76 on one side of the piston, the piston slides along the central shaft. Since the main body 76 is rotationally fixed relative to the swivel bracket 50, the oblique spline teeth cause the central shaft and therefore the upper and lower drive unit mounting bracket 78, 80, to pivot about the steering axis 30. The connections between the drive unit 12 and the upper and lower drive unit mounting brackets 78, 80 cause the drive unit 12 to pivot about the steering axis 30 together with the central shaft. Supplying hydraulic fluid to one side of the piston causes the drive unit 12 to steer left. Supplying hydraulic fluid to the other side of the piston causes the drive unit 12 to steer right. In the present implementation, supplying hydraulic fluid above the piston causes the drive unit 12 to steer left and supplying hydraulic fluid below the piston causes the drive unit 12 to steer right.

U.S. Pat. No. 7,736,206 B1, issued Jun. 15, 2010, provides additional details regarding rotary actuators similar in construction to the rotary actuator 28. It is contemplated that the rotary actuator 28 could be replaced by a linear hydraulic actuator connected between the swivel bracket 50 and the drive unit 12.

The upper drive unit mounting bracket 78 has a forwardly extending arm 84. Two linkages 86 are pivotally fastened to the top of the arm 84. When more than one outboard engine is provided on the transom 16 of the watercraft, one or both of the linkages 86, depending on the position and number of outboard engines, of the outboard engine 10 are connected to rods which are connected at their other ends to corresponding linkages on the other outboard engines. Accordingly, when the outboard engine 10 is steered, the linkages 86 and rods cause the other outboard engines to be steered together with the outboard engine 10.

Two arms 88 extend from the upper end of the swivel bracket 50. As can be seen in FIG. 9, these arms 88 are provided with threaded apertures 90. These apertures 90 are used to fasten the box 48 to the swivel bracket 50 such that the box 48 pivots about the tilt/trim axis 24 together with the swivel bracket 50.

The bracket assembly 14 is provided with a hydraulic unit 100 for supplying hydraulic fluid to the rotary actuators 26, 28 and the linear actuators 22. As best seen in FIG. 9, the hydraulic unit 100 is mounted to the swivel bracket 50 so as to pivot together with the swivel bracket 50 about the tilt-trim axis 24. It is contemplated that in some alternative implementations of the present bracket assembly 14, that the hydraulic unit 100 or some elements thereof could be mounted to the stern bracket 52 instead.

Figure 10:
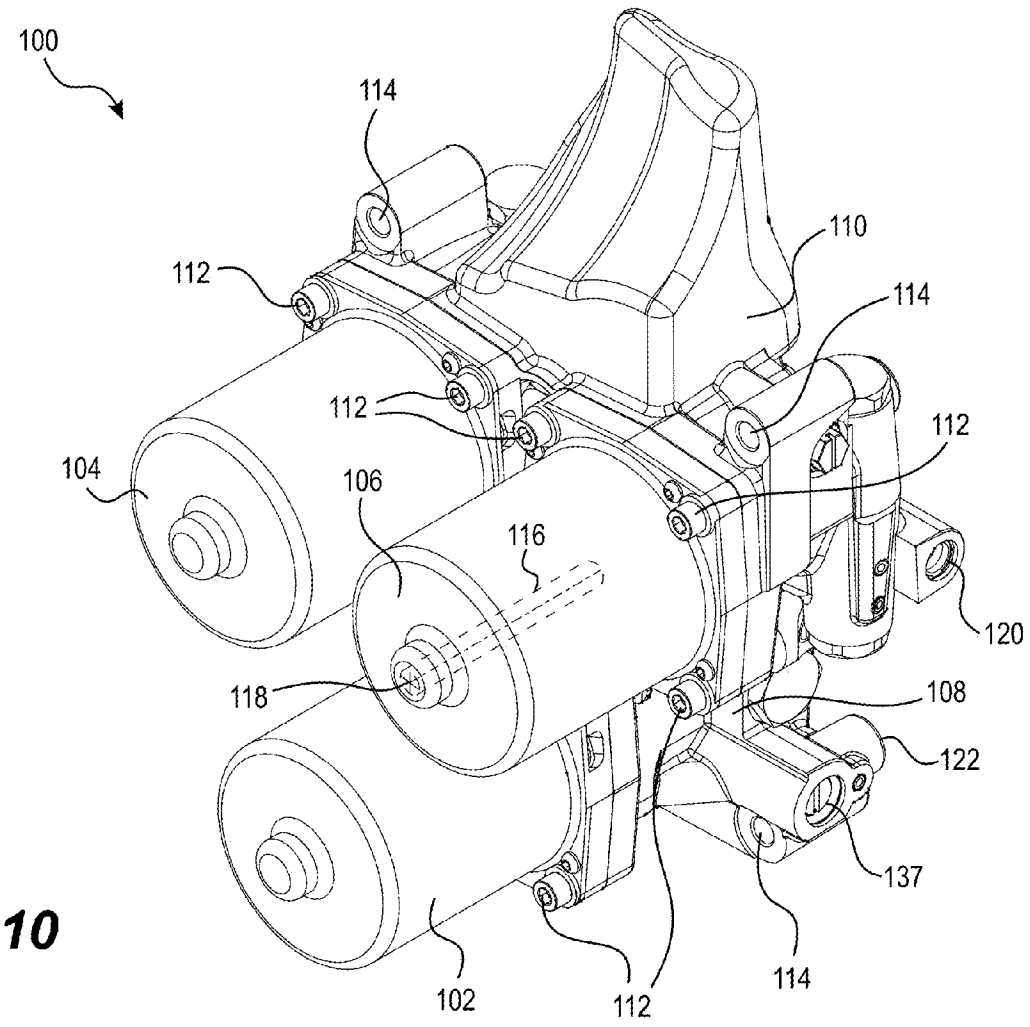
FIG. 10 is a perspective view taken from a front, left side of a hydraulic unit of the bracket assembly of FIG. 7.

As best seen in FIG. 10, the hydraulic unit 100 includes three pumps 102, 104, 106, a valve unit 108, and a hydraulic fluid reservoir 110. The pumps 102, 104, 106 are mounted via fasteners 112 to the valve unit 108. The valve unit 108 is mounted to the swivel bracket 50 via fasteners (not shown). The fluid reservoir 110 is disposed on top of the valve unit 108 and is fastened to the valve unit 108.

Figure 8:
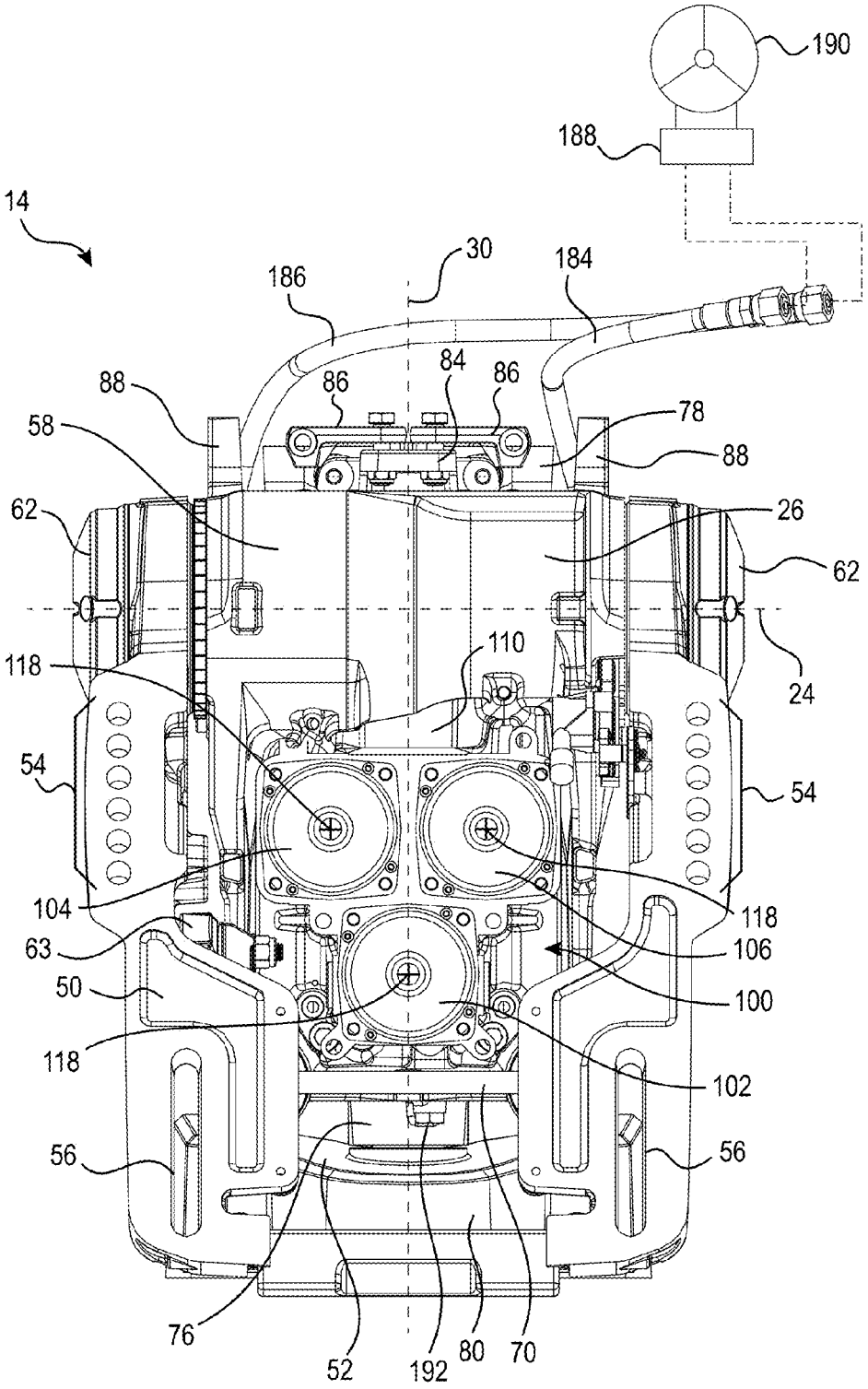
FIG. 8 is a front elevation view of the bracket assembly of FIG. 7.

As best seen in FIG. 8, when mounted to the swivel bracket 50, the pumps 102, 104, 106 are disposed in a triangular arrangement. In this arrangement, the pump 102 is disposed on a lower half of the swivel bracket 50 along a lateral center of the swivel bracket 50, which corresponds to the steering axis 30 in FIG. 8.

The pumps 102, 104, 106 are bi-directional electric pumps. Each pump 102, 104, 106 includes a motor (not shown), a shaft 116 (shown in dotted lines only for pump 106 in FIG. 12) and a pumping member (not shown). The motor is connected to the shaft 116 which is itself connected to the pumping member. The motor drives the pumping member by causing the shaft 116 to rotate about a pump axis 118. The direction of the flow of hydraulic fluid from each pump 102, 104, 106 can be changed by changing the direction of rotation of their respective motors. It is contemplated that the pumps 102, 104, 106 could be unidirectional pumps, in which case it is contemplated that a system of valves could be used to vary the direction of the flow. It is also contemplated that other types of pumps could be used, such as, for example, axial flow pumps or reciprocating pumps. When they are mounted to the swivel bracket 50, the pump axes 118 of the pumps 102, 104, 106 are generally perpendicular to the tilt/trim axis 24 and to the steering axis 30 as can be seen in FIG. 8. The volume of each pump 102, 104, 106 acts as a hydraulic fluid reservoir.

The pump 102 is used to supply hydraulic fluid to the rotary actuator 26 and the linear actuators 22. Therefore, actuation of the pump 102 controls the tilt and trim. It is contemplated that the pump 102 could be replaced with two pumps: one controlling the upward motion (tilt/trim up), and another controlling the downward motion (tilt/trim down). The pump 102 is fluidly connected to the fluid reservoir 110 via the valve unit 108.

The pump 102 is fluidly connected to the linear actuators 22 via a valve assembly (not shown) located in the valve unit 108 to trim up and trim down the swivel bracket 50. Similarly, the pump 102 is fluidly connected to the rotary actuator 26 via another valve assembly (not shown) located in the valve unit 108 to tilt up and tilt down the swivel bracket 50. Each of the valve assemblies used to connect the linear actuator 22 and the rotary actuator 26 to the pump 102 is a shuttle type spool valve. The shuttle type spool valve is described in detail in U.S. Provisional patent application Ser. No. 14/606,636, filed on Jan. 27, 2015, the entirety of which is incorporated herein by reference. It is contemplated that other types of valves or valve assemblies could be used instead of the valve assembly 128.

It should be noted that, as the swivel bracket 50 is being trimmed up or down by the linear actuators 22 by supplying fluid to the cylinders 64, fluid is being simultaneously supplied to the rotary actuator 26 to obtain the same amount of angular movement in the same direction and at the same rate. A screw 137 (FIG. 10) provided on the left side of the valve unit 108 can be turned manually to open a manual release valve (not shown) to permit the drive unit 12 to be turned freely about the tilt/trim axis 24. To access the screw 137, an aperture 139 (FIG. 9) is defined in the side of the swivel bracket. The pump 102 is actuated in response to the actuation by the driver of the watercraft of tilt and trim actuators (not shown) in the form of switches, buttons or levers for example. It is contemplated that the pump 102 could also be controlled by an engine management module (EMM) 404 (shown in FIG. 15) of the outboard engine 10 or of the watercraft to automatically adjust a trim of the drive unit 12 based on various parameters such as watercraft speed, engine speed and engine torque for example.

The pumps 104 and 106 are used to supply hydraulic fluid to the rotary actuator 28. Therefore, actuation of the pumps 104 and 106 control left and right steering of the drive unit 12. In the present implementation, both pumps 104, 106 are used for both left and right steering motion. It is contemplated that only one of the pumps 104, 106 could be used for providing the left steering motion with the other one of the pumps 104, 106 being used for providing the right steering motion. It is also contemplated that each one of the pumps 104, 106 could normally be used for providing one steering motion each with the other one of the pumps 104, 106 being used to provide a boost in pressure to steer when needed or to provide the pressure in case of failure of the pump normally being used to steer in a particular direction. It is also contemplated that only one pump could be used to supply the hydraulic pressure to the rotary actuator 28 to steer both left and right.

The pumps 104, 106 are fluidly connected to the rotary actuator 28 via respective valve assemblies (not shown) located in the valve unit 108. The valve assemblies are also spool type valve assemblies, but it is contemplated that other types of valves and valve assemblies could be used.

Figure 7:
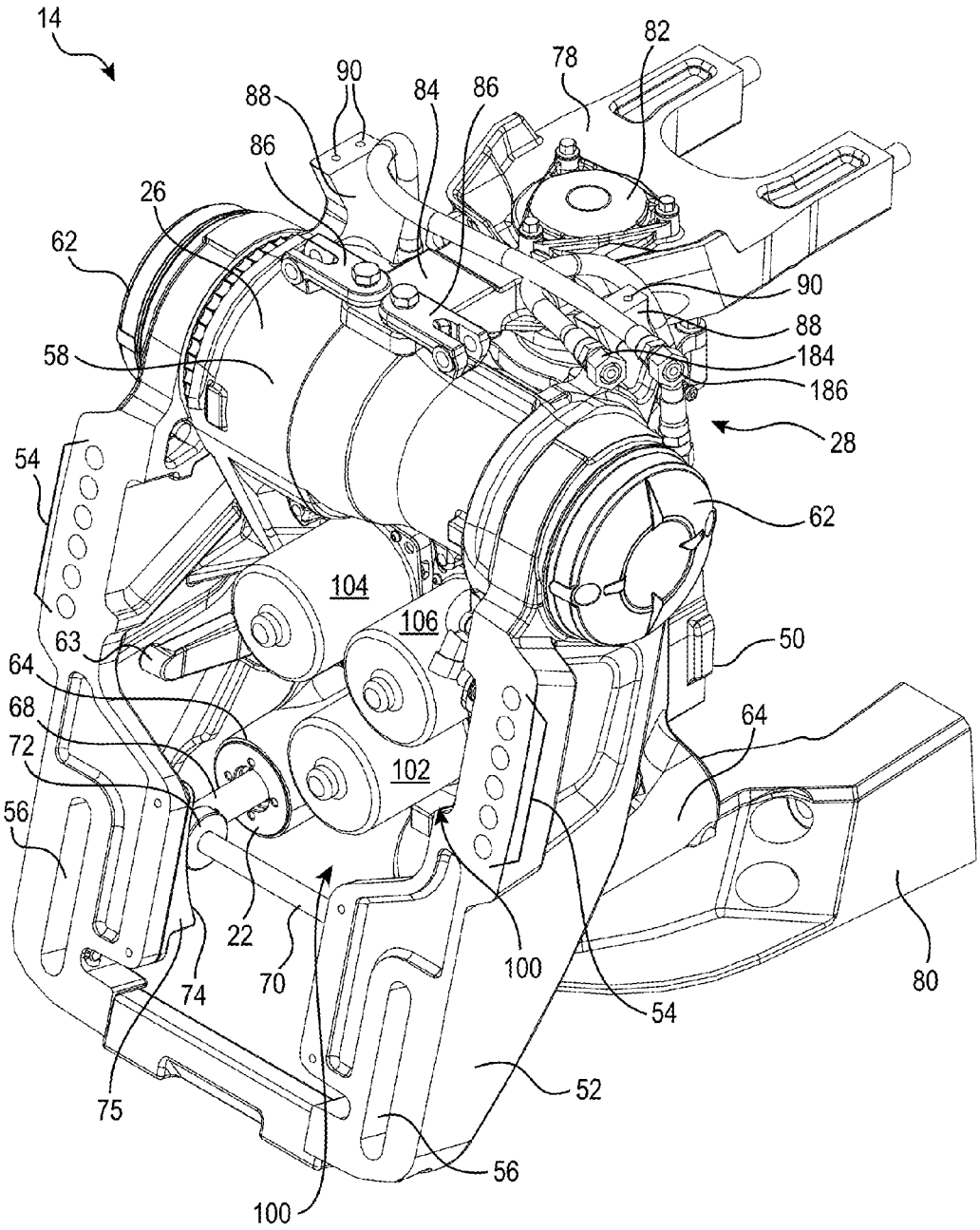
FIG. 7 is a perspective view taken from a front, left side of a bracket assembly of the outboard engine of FIG. 1.

The pumps 104, 106 are actuated in response to signals received from one or more sensors sensing a position of a helm assembly 190 (FIG. 8) of the watercraft. The helm assembly 190 includes a steering operator such as a steering wheel, or the like for steering the watercraft. A hydraulic actuator 188 disposed inside the watercraft is driven by the helm assembly 190. As described below, the hydraulic actuator 188 is optionally fluidly connected to the rotary actuator 28 via the swivel bracket 50 for steering the watercraft. As illustrated in FIGS. 7 to 9, the bracket assembly 14 is provided with hydraulic lines 184, 186 connected to openings (not shown) in the sides of the swivel bracket 50. The opening in the swivel bracket 50 for the line 184 communicates with a passage in the swivel bracket 50 that is fluidly connected to the rotary actuator 28. The opening in the swivel bracket 50 for the line 186 communicates with another passage in the swivel bracket 50 that is fluidly connected to the rotary actuator 28. The lines 184, 186 are routed through the box 48 and are fluidly connected to a hydraulic actuator 188 driven by the helm assembly 190 of the watercraft as schematically illustrated in FIG. 8. When the driver turns the helm assembly 190 left, the actuator 188 pushes hydraulic fluid in the line 184, which is then supplied to the rotary actuator 28 to cause the drive unit 12 to turn left. When the driver turns the helm assembly 190 right, the actuator 188 pushes hydraulic fluid in the line 186 which is then supplied to the rotary actuator 28 to cause the drive unit 12 to turn right. The pumps 104, 106 are actuated in response to rotation of the helm assembly 190 to supplement the hydraulic pressure supplied by the lines 184, 186. The hydraulic lines 184, 186 are optional. When the optional lines 184, 186 are not being used, as in the case of a steering-by-wire system, their respective openings in the swivel bracket 50 are capped.

The valve unit 108 has several apertures that fluidly communicate with corresponding apertures of the swivel bracket 50 for supplying fluid to and from the pumps 102, 104, 106 to the actuator 22, 26, 28. When the hydraulic unit 100 is mounted to the swivel bracket, each aperture of the valve unit 108 is disposed adjacent to and aligned with the corresponding aperture of the swivel bracket 50. As such, no hydraulic lines need to be connected between corresponding apertures, which simplifies the mounting of the hydraulic unit 100 to the swivel bracket 50.

Figure 12:
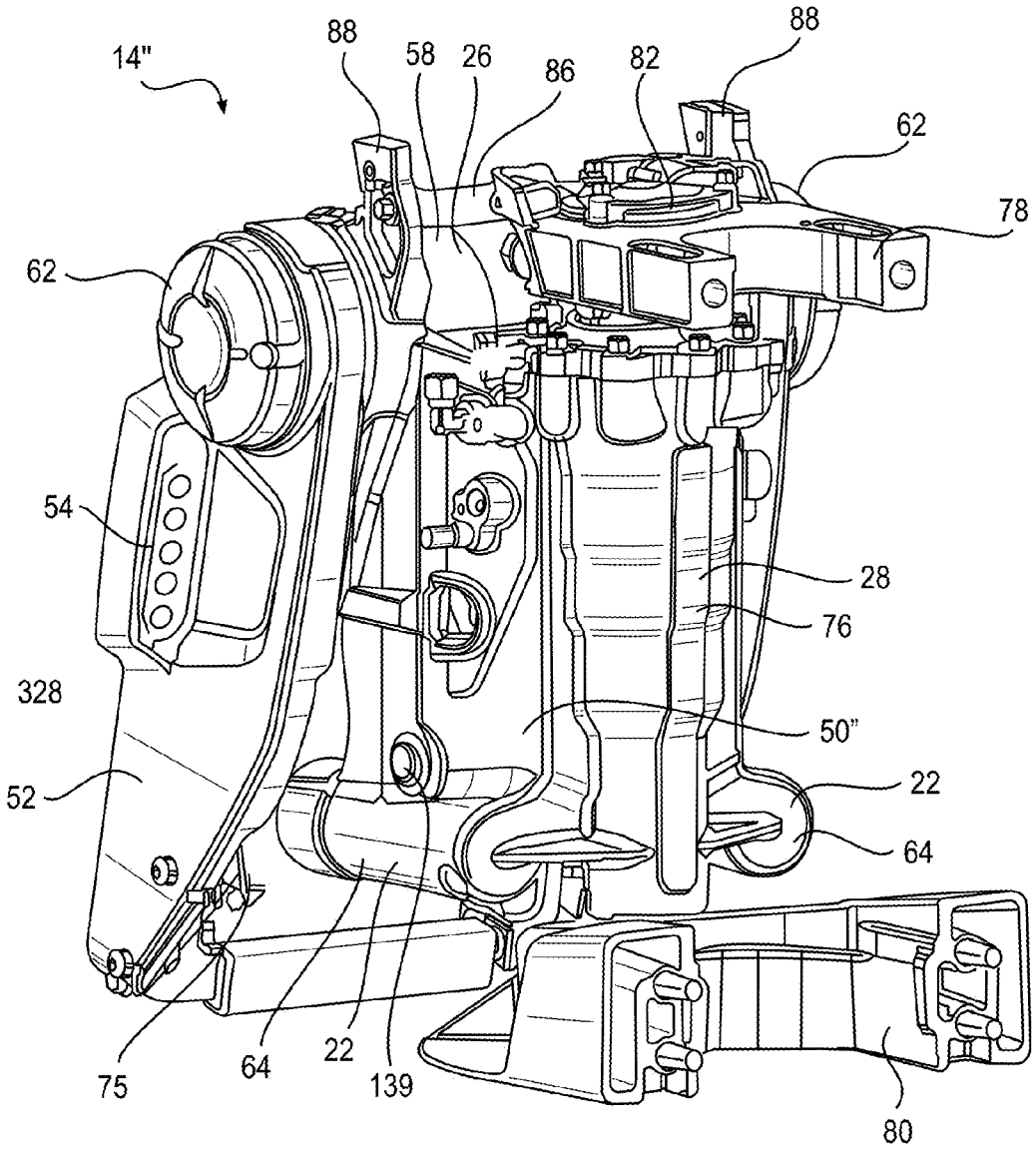
FIG. 12 is a perspective view taken from a rear, left side of the bracket assembly of FIG. 11.

With reference to FIG. 10, the fluid reservoir 110 is fluidly connected to the hydraulic circuits of the pump 102, 104, 106 in order to compensate for the variation in volume of the hydraulic fluid therein caused by the displacement of the respective pistons. It is contemplated that the fluid reservoir 110 could be connected only to the hydraulic circuit of the pump 102. For example, if the pumps 104, 106 are connected to a separate fluid reservoir which would allow the use of different hydraulic fluids for the tilt/trim pump 102 and the steering pumps 104, 106. Hydraulic fluid can be added to the fluid reservoir 110 via a reservoir inlet 120. When the hydraulic unit 100 is mounted to the swivel bracket 50, the reservoir inlet 120 is in alignment with an aperture (not shown) in the side of the swivel bracket 50. As such, the reservoir 110 can be filled without having to remove it from the swivel bracket 50. As can be seen in FIG. 12, the reservoir inlet 120 is located below the main volume of the reservoir 110 when the swivel bracket is in the upright position. To fill the reservoir 110, the swivel bracket 50 is tilted up to its highest position. This brings at least a portion of the main volume of the reservoir 110 below the reservoir inlet 120. Filling the reservoir 110 in this position up to the level of the inlet 120 ensures that the proper amount of hydraulic fluid is present in the reservoir 110. To drain the hydraulic fluid from the hydraulic unit 100, a threaded fastener 192 (FIG. 8) is removed from an aperture (not shown) in the bottom of the swivel bracket 50. Hydraulic fluid from the hydraulic unit 100 flows out of the valve unit 108, through a passage integrally formed in the swivel bracket 50, and out through the aperture at the bottom of the swivel bracket 50.

Turning now to FIGS. 11 to 14, a bracket assembly 14", which is an alternative implementation of the bracket assembly 14 described above, will be described. The bracket assembly 14" is the same as the bracket assembly 14 except that the hydraulic unit 100 has been replaced by a hydraulic unit 200 for tilt/trim of the outboard engine 10 and a hydraulic unit 300 for steering. In addition, the swivel bracket 50 has been replaced by a swivel bracket 50" in the bracket assembly 14". The swivel bracket 50" is the same as the swivel bracket 50 except that the configuration of apertures for fluid connection to the actuators 22, 26, 28 has been modified to correspond to the hydraulic units 200, 300. Therefore, for simplicity, elements of the bracket assembly 14" that are the same as those of the bracket assemblies 14 have been labeled with the same reference numerals and will not be described again in detail.

Figure 11:
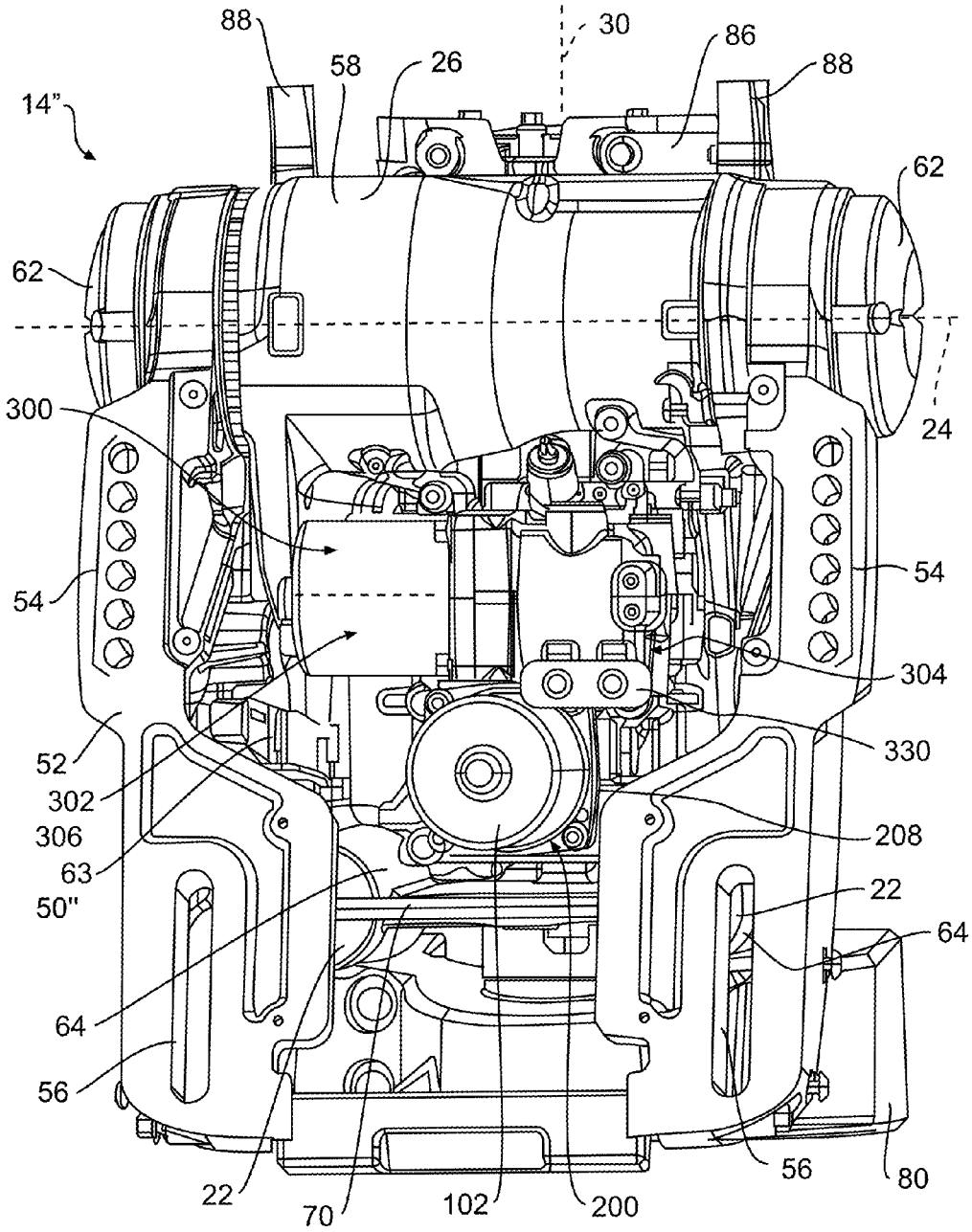
FIG. 11 is a perspective view taken from a front, left side of another alternative implementation of a bracket assembly of the outboard engine of FIG. 1.

The hydraulic unit 200 includes a pump 102 (same type as above), and a valve unit 208. The pump 102 is mounted to the valve unit 208 via fasteners 112. The valve unit 208 is mounted to the swivel bracket 50" via fasteners. As best seen in FIG. 11, the pump 102 is disposed on a lower half of the swivel bracket 50 along a lateral center of the swivel bracket 50, which corresponds to the steering axis 30.

The pump 102 is used to supply fluid to the linear actuators 22 and the rotary actuator 26. The pump 102 is therefore used in tilting and trimming the swivel bracket 50 relative to the stern bracket 52. It is also contemplated that at least some elements of the hydraulic unit 200 could be mounted to the stern bracket 52. The valve unit 208 is provided with various apertures that fluidly communicate with corresponding apertures of the swivel bracket 50" for supplying fluid to and receiving fluid from the actuators 22, 26.

With reference to FIGS. 11 to 14, the hydraulic unit 300 includes a pump 302, and a valve unit 304.

The pump 302 is mounted to the valve unit 304 via fasteners (not shown). The pump 302 is a unidirectional electric pump, but it is contemplated that other types of pumps could be used. The pump 302 is used to supply hydraulic fluid to the rotary actuator 28. The pump 302 is fluidly connected to the rotary actuator 28 via a valve assembly (not shown) located inside the valve unit 304. Therefore, actuation of the pump 302 controls left and right steering of the drive unit 12. It is contemplated that two pumps could be used to control steering as in the hydraulic unit 100 described above.

Figure 13:
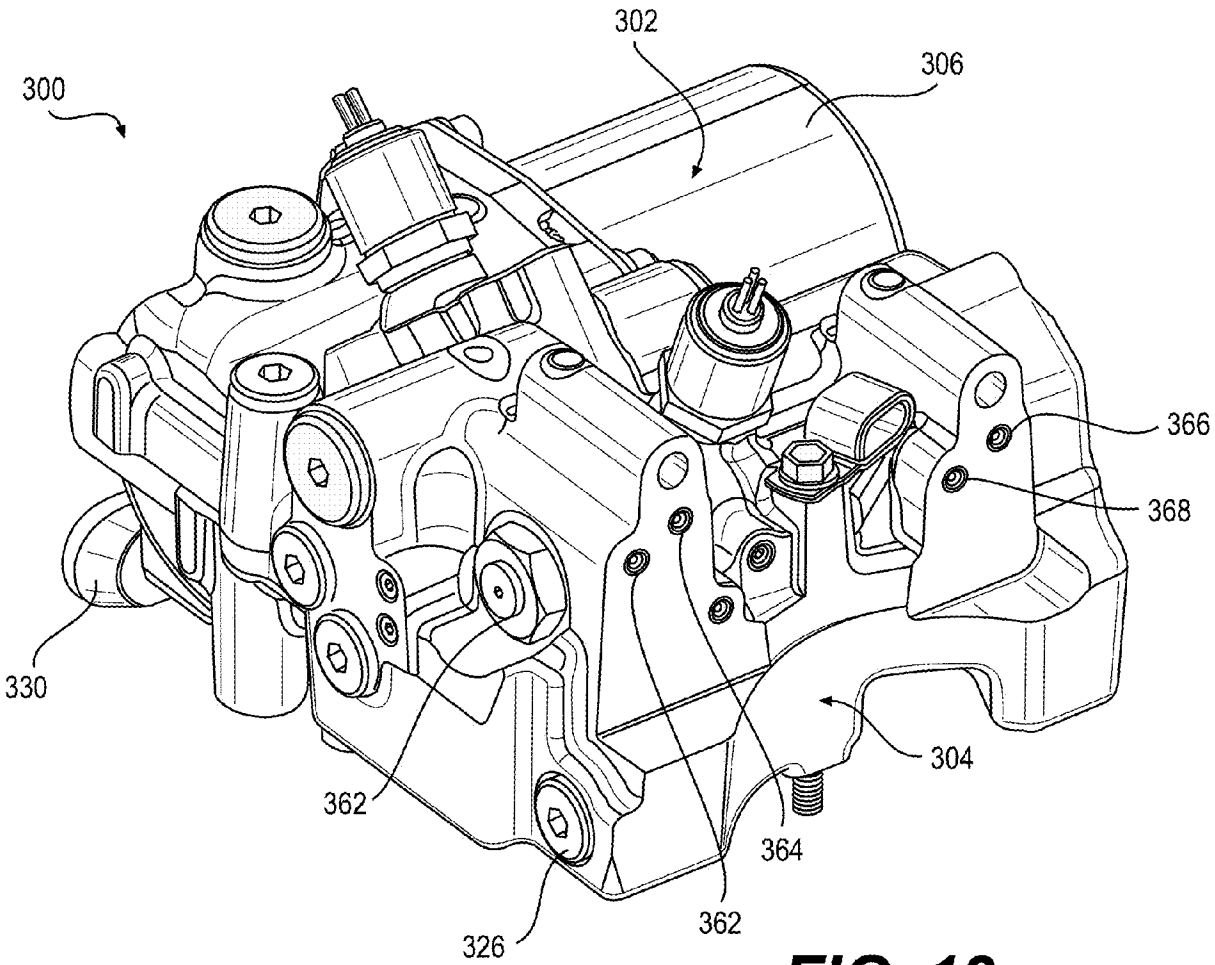
FIG. 13 is a perspective view taken from a rear, left side of a hydraulic unit of the bracket assembly of FIG. 11.
Figure 14:
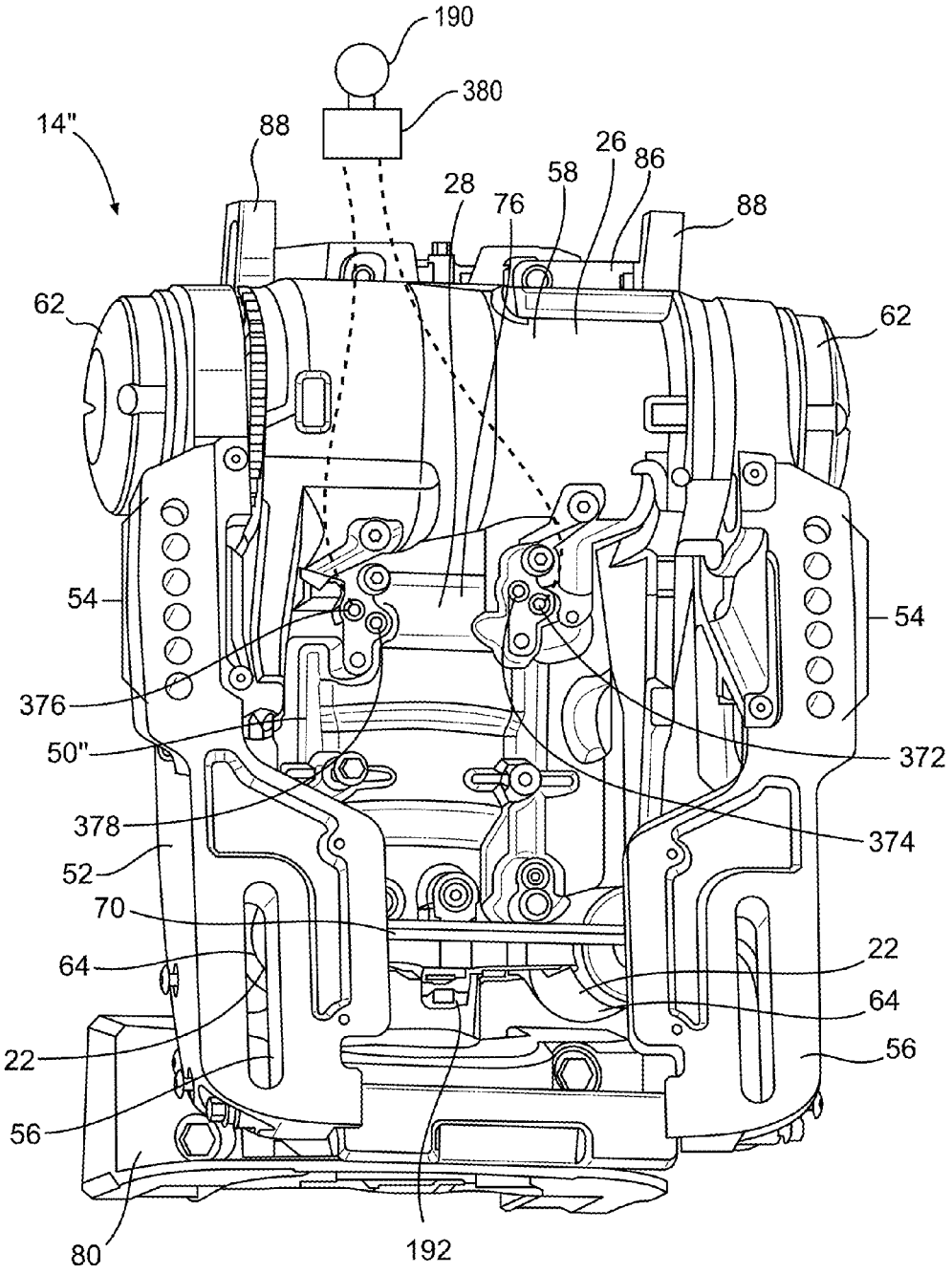
FIG. 14 is a perspective view of the bracket assembly FIG. 11 with the hydraulic units removed.

The valve unit 304 connects fluidly with the rotary actuator 28 via the swivel bracket 50". In addition, the valve unit 304 also connects fluidly, via the swivel bracket 50", to a hydraulic unit 380 (FIG. 14) driven by the helm assembly 190 of the watercraft. As can be seen in FIG. 13, apertures 362, 364, 366 and 368 are defined on a rear side of the valve unit 304 and fluidly communicate with the valve assembly of the valve unit 304 via passages integrally formed in the valve unit 304. When the hydraulic unit 300 is mounted to the swivel bracket 50", the apertures 362, 364, 366 and 368 of the valve unit 304 are in alignment with and adjacent to corresponding apertures 372, 374, 376 and 378 respectively (FIG. 14) defined in the swivel bracket 50". As such, no hydraulic lines need to be connected between the apertures 362, 364, 366 and 368 and the apertures 372, 374, 376 and 378, which simplifies the mounting of the hydraulic unit 300 to the swivel bracket 50". The apertures 372 and 376 of the swivel bracket 50" fluidly communicate with the hydraulic unit 380 driven by the helm assembly 190. The apertures 374 and 378 fluidly communicate with opposite sides of a piston 382 (shown schematically in FIG. 15) of the rotary actuator 28 via passages integrally formed in the swivel bracket 50" and the main body 76 of the rotary actuator 28.

The hydraulic unit 300 is disposed on top of the hydraulic unit 200. The valve unit 304 is fastened to the valve unit 208 by fasteners (not shown). The valve unit 304 defines a fluid reservoir (not shown) containing hydraulic fluid to be supplied to the valve unit 208 of the hydraulic unit 200, and also adapted to receive hydraulic fluid from the valve unit 208. An aperture (not shown) in the top of the valve unit 208 is aligned with and connected to an aperture (not shown) in the bottom of the valve unit 304. A filter (not shown) disposed inside the valve unit 304 about the aperture 324 filters hydraulic fluid flowing to the valve unit 208.

With reference to FIGS. 12 and 13, the hydraulic unit 300 defines a reservoir inlet closed by a cap 326 (FIG. 13) by which hydraulic fluid can be added to the fluid reservoir defined by the valve unit 304. When the hydraulic unit 300 is mounted to the swivel bracket 50", the reservoir inlet is in alignment with an aperture 328 (FIG. 12) in the side of the swivel bracket 50". As such, the reservoir defined by the valve unit 304 can be filled without having to remove it from the swivel bracket 50". To fill the reservoir defined by the valve unit 304, the swivel bracket 50" is tilted up to its highest position and the cap 326 is removed via the aperture 328. This brings at least a portion of the main volume of the reservoir defined by the valve unit 304 below the reservoir inlet. Filling the reservoir defined by the valve unit 304 in this position up to the level of the reservoir inlet ensures that the proper amount of hydraulic fluid is present in the reservoir.

As can be seen in FIG. 11, the hydraulic unit 300 is disposed below the tilt/trim axis 24 and between the drive unit mounting brackets 78, 80. The stern bracket 52 defines a space laterally between its left and right portions. When the swivel bracket 50" is within at least a portion of the range of trim angles, such as in the illustrated upright position, at least a portion of the pumps 102, 302 and the valve units 208, 304 is disposed inside that space.

As can be seen in FIG. 11, an anode 330 is fastened to the front of the valve unit 304. The anode 304 helps prevent corrosion of the components of the bracket assembly 14". It is contemplated that the anode 330 could be omitted and/or that one or more anodes 330 could be disposed elsewhere on the bracket assembly 14".

With respect to FIG. 15, the general operation of the power steering system and a power steering control system 400 will now be described.

When the driver of the watercraft turns the steering wheel of the helm assembly 190 to turn left or right (port or starboard), the hydraulic unit 380 supplies hydraulic fluid to the valve assembly in the valve unit 304, which routes hydraulic fluid to and from the pump 302 and the rotary actuator 28 for steering the watercraft based in part on the input from the helm assembly 190.

Figure 15:
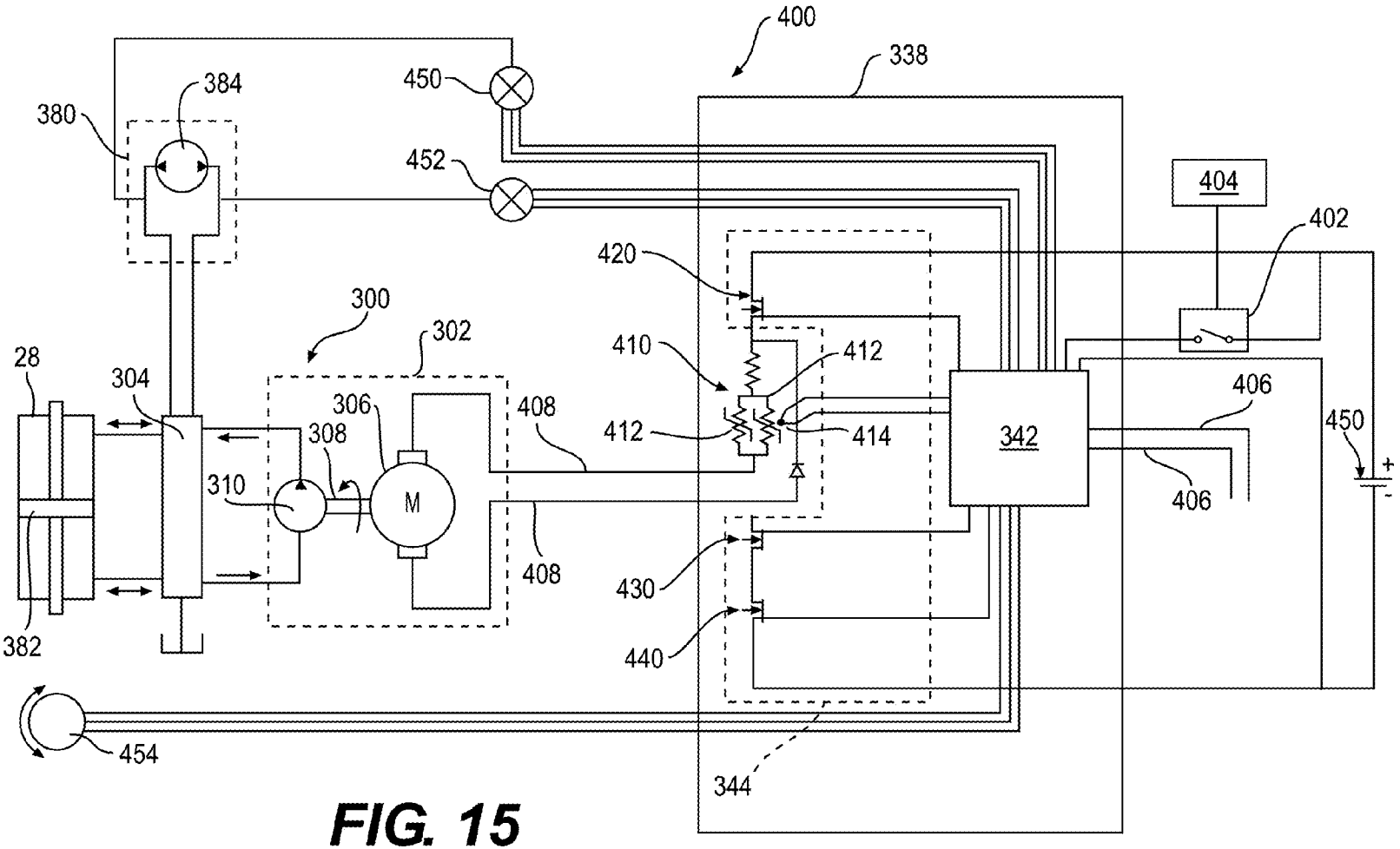
FIG. 15 is a schematic diagram of a power steering system of the outboard engine of FIG. 1.

As is schematically illustrated in FIG. 15, the pump 302 includes a motor 306, a shaft 308 and a pumping member 310. The motor 306 is connected to the shaft 308 which is connected to the pumping member 310. The motor 306 thereby drives the pumping member 310 via the shaft 308. In the illustrated implementation, the motor 306 is disposed outside the valve unit 304 (FIG. 13), the pumping member 310 is disposed inside the valve unit 304, and the shaft 308 extends between the two.

The helm hydraulic unit 380 includes a hydraulic actuator, which in the present implementation is a bi-directional mechanically driven helm pump 384. The helm pump 384 is driven by the helm assembly 190 via gears for example. It is contemplated that the helm pump 384 could be driven by a bi-directional electric motor actuated in response to a signal received from a steering position sensor sensing a position of the helm assembly 190.

For steering the watercraft, the operation of the rotary actuator 28 and the pump 302 is controlled by a power steering control system 400. The power steering control system 400 includes a control module 338 and several sensors connected to the control module 338.

The control module 338 includes a controller 342 and a motor drive 344. The controller 342 receives signals from various sensors and switches described below to determine if and how the pump 302 should be operated. The motor drive 344 consists of one or more circuits that drive the motor 306 based on a signal received from the controller 342 to operate the pump 302 as determined by the controller 342. The motor drive 344 will be described below in further detail. It is contemplated that some or all of the functions of the control module 338 could be integrated at least in part in the EMM 404 of the engine 36.

Figure 17:
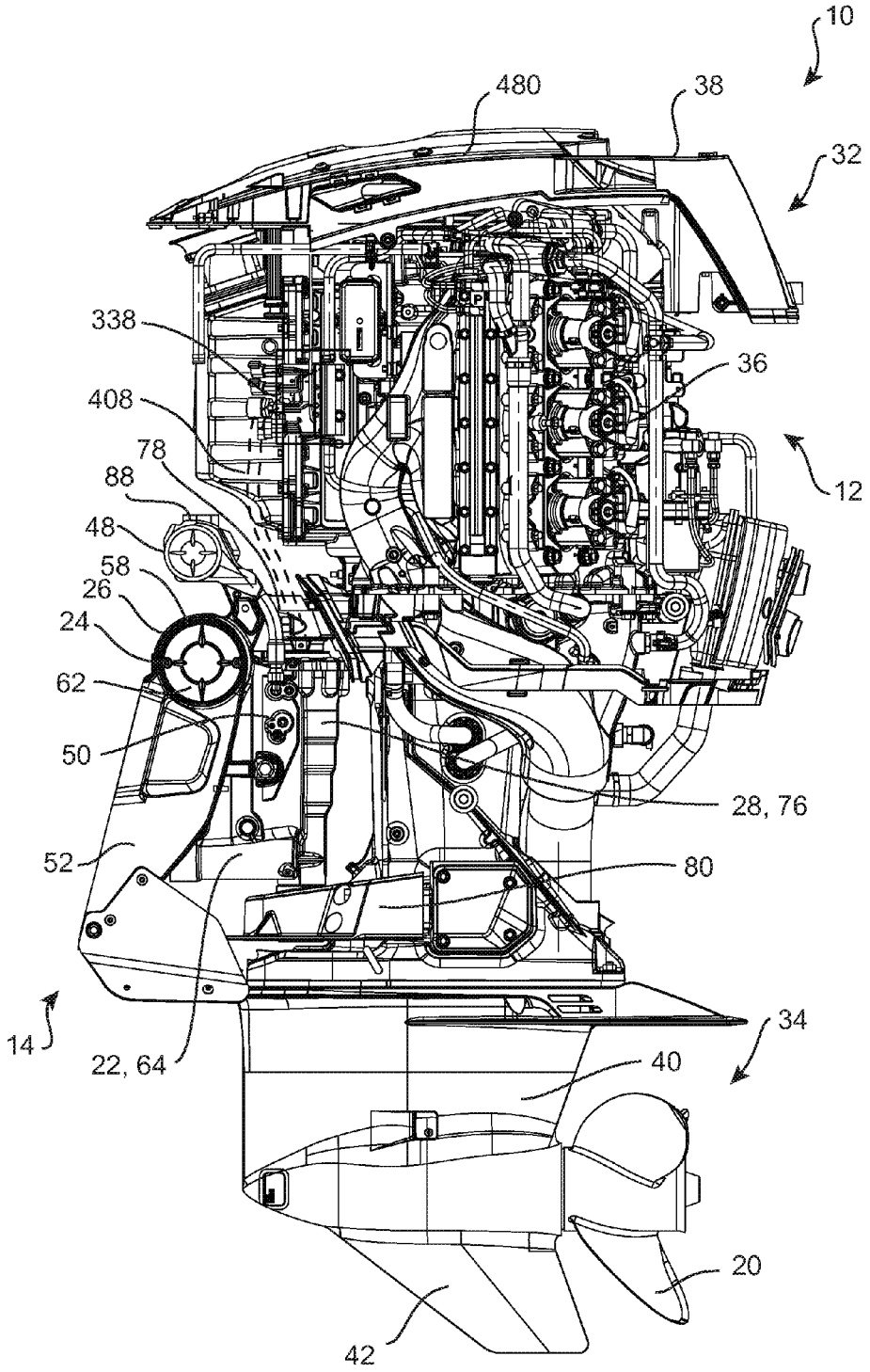
FIG. 17 is a left side elevation view of the outboard engine of FIG. 1 with a portion of the cowling removed to show a power steering control module enclosed therein.
Figure 18:
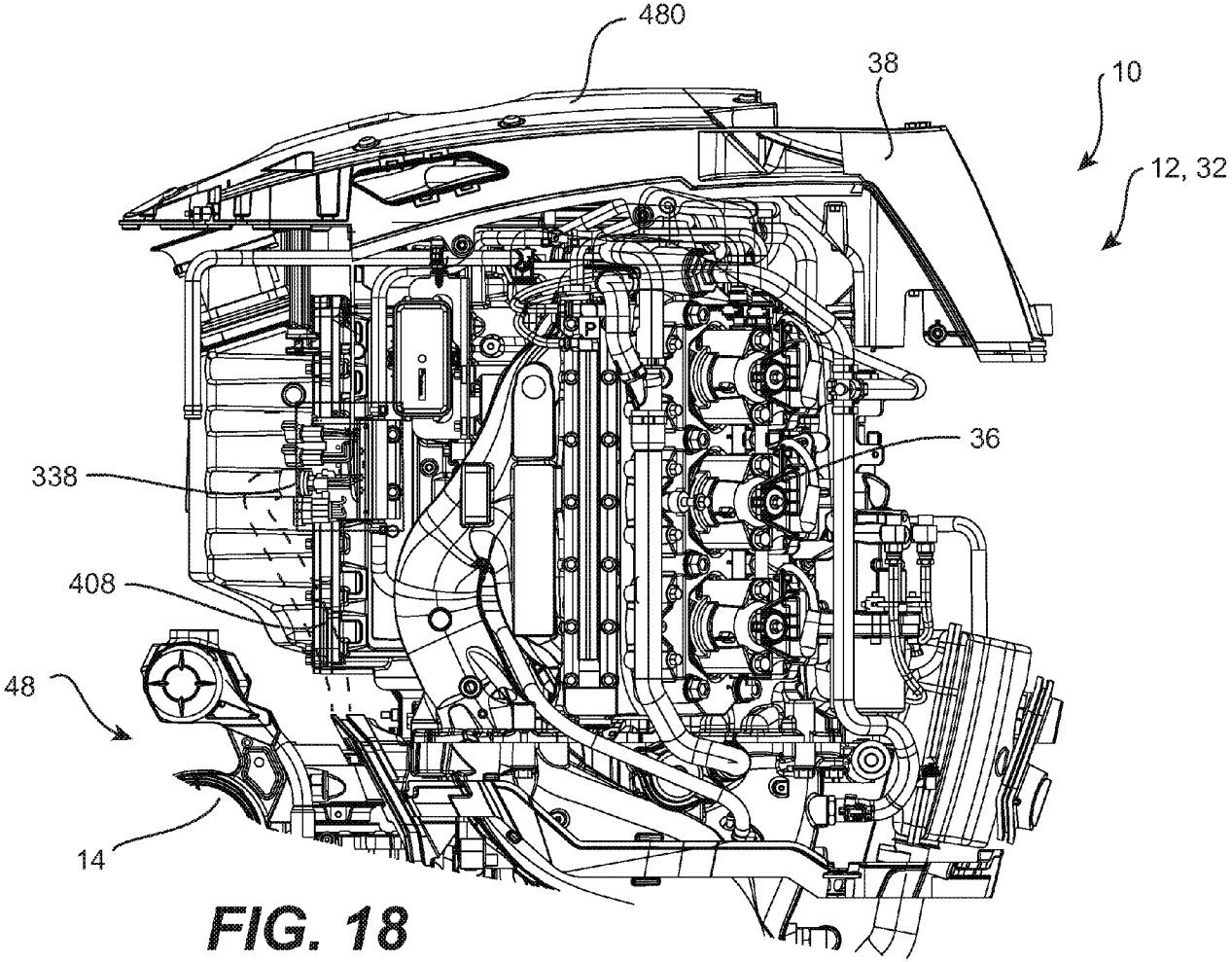
FIG. 18 is a close-up left side elevation view of a portion of the outboard engine and the power steering control module of FIG. 17.
Figure 19:
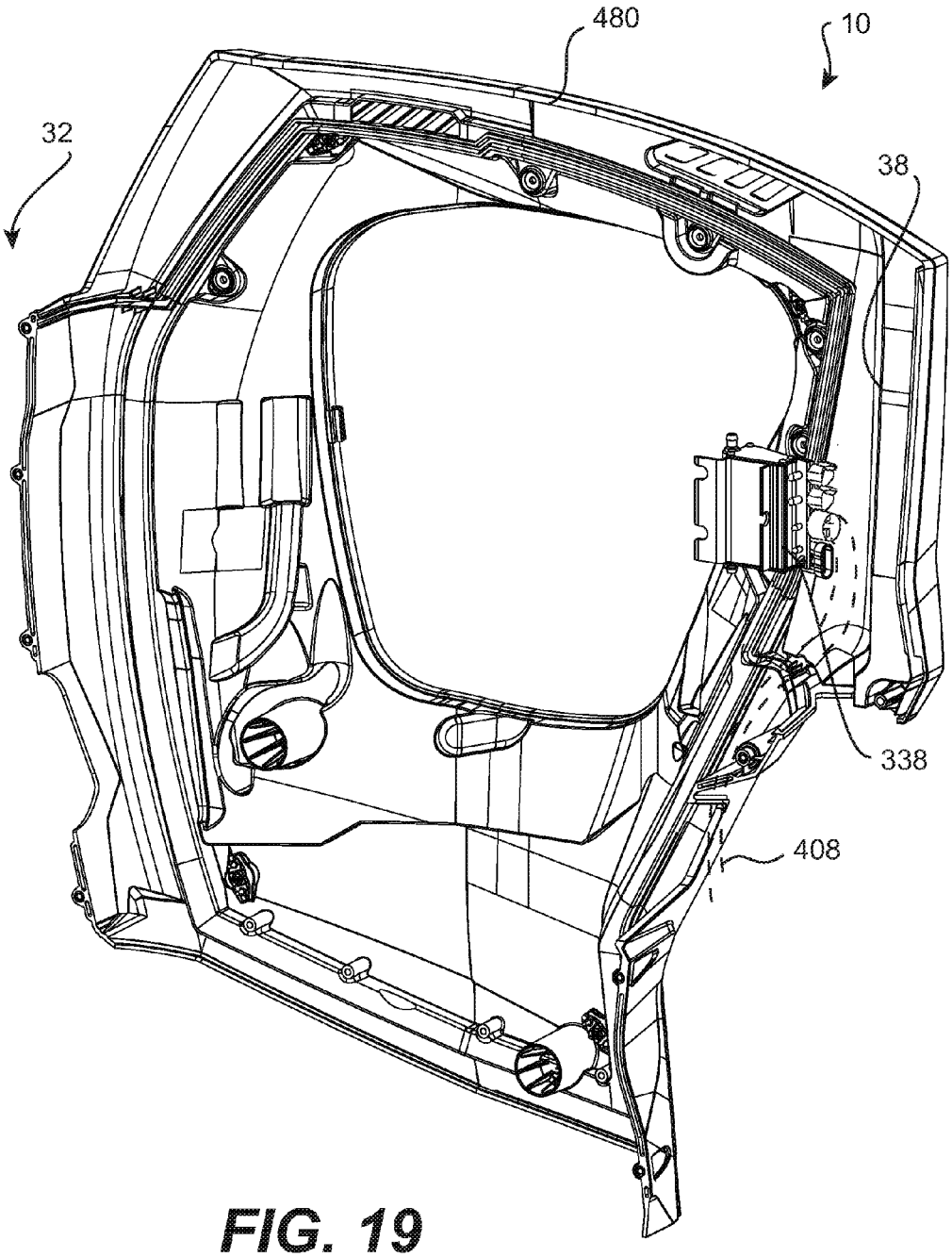
FIG. 19 is a perspective view, taken from a front, right side, of a left portion of the cowling and the power steering control module of FIG. 18.

With reference to FIGS. 17 to 19, the control module 338 is disposed in the drive unit 12 and is enclosed by the cowling 38. The cowling 38 therefore protects the control module 338 from moisture, dust and the like. In the illustrated implementation, the control module 338 is disposed under the top panel 480 and mounted to the cowling 38 to a central support structure thereof. The control module 338 is therefore pivotable with the drive unit 12 about the steering axis 30. It is contemplated that the control module 338 could not be enclosed by the cowling 38. Details about the structure of the cowling 38 can be found in U.S. patent application Ser. No. 14/230,438 filed on Mar. 31, 2014, the entirety of which is incorporated herein by reference.

The controller 342 is in communication with pressure sensors 450, 452 and a steering sensor 454 for controlling steering.

During operation of the hydraulic unit 380, one of the pressure sensors 450, 452 senses the hydraulic pressure of hydraulic fluid flowing into the valve unit 304 from the hydraulic unit 380, while the other of the pressure sensors 450, 452 senses the hydraulic pressure of hydraulic fluid flowing out of the valve unit 304 to the hydraulic unit 380. The direction of flow of hydraulic fluid being sensed by the pressure sensors 450, 452 depends on the direction or rotation of the helm assembly 190.

The pressure sensor 450 is positioned to sense the hydraulic pressure in a passage defined in the hydraulic unit 300 and connecting to the aperture 362. The pressure sensor 450 sends a signal representative of the sensed pressure to the controller 342. The pressure sensor 452 is positioned to sense the hydraulic pressure in a passage defined in the hydraulic unit 300 and connected to the aperture 366. The pressure sensor 452 sends a signal representative of the sensed pressure to the controller 342.

The control module 338 regulates the operation of the pump 302 by controlling the speed of the motor 306. This speed is determined at least in part by the hydraulic fluid pressure sensed by the pressure sensors 450, 452. If the difference between the pressures of the hydraulic fluid sensed by the pressure sensors 450, 452 are above a predetermined value, 6 psi for example, the power steering control module 338 causes the motor 306 to run.

As can be seen in FIG. 15, the steering position sensor 454 senses the angular position of the drive unit 12 about the steering axis 30. In the present implementation, the steering position sensor 454 is disposed on top of the rotary actuator 28, but it is contemplated that the sensor 454 could be disposed elsewhere on the bracket assembly 14". In the present implementation, the steering position sensor 454 is a magnetic rotary position sensor, but other types of sensors are also contemplated. The steering position sensor 454 is in communication with the controller 342 and sends a signal thereto representative of the angular position of the drive unit 12 about the steering axis 30. The control module 338 causes the motor 306 to stop operating when the angular position of the drive unit 12 about the steering axis 30 corresponds to the maximum steering position (left or right) of the drive unit 12. It is also contemplated that tilt/trim position sensors could be provided to similarly control the tilting and trimming operation.

It is contemplated that instead of, or in addition to the sensors 450, 452, steering could be controlled based on a high pressure sensor provided downstream of the pump 302 and a low pressure sensor provided upstream of the pump 306. Additional details regarding a steering system having such high and low pressure sensors, and operation thereof, can be found in U.S. patent application Ser. No. 14/606,636 filed on Jan. 27, 2015, the entirety of which is incorporated herein by reference.

It is contemplated that the control module 338 could also regulate the operation of the pump 302 as a function of one or more operational characteristics of the watercraft and the outboard engine 12 such as, for example, watercraft speed, throttle request, engine speed and a mode of operation selection made by the operator. The power steering control module 338 is in communication with the EMM 404 and communication circuitry 406 of the engine 36 to obtain information regarding the one or more operational characteristics.

As the watercraft is steered, various components of the hydraulic unit 300, such as the motor 306, heat up. In order to protect the motor 306 from overheating, the control module 338 is configured to control operation of the motor 306 based on a temperature of the motor 306 as will be described below.

As mentioned above, the controller 342 is connected to the motor 306 via the motor drive 344. The motor drive 344 will now be described with reference to FIG. 15.

The motor drive 344 includes a pulse width modulation (PWM) switch 420, a reverse battery protection switch 430, a power connect switch 440. The motor drive 344 connects the motor 306 to a power source 450. The electrical wires 408 (FIGS. 15, and 17 to 19) connecting the motor drive 344 to the motor 306 are enclosed in a braided sleeve. The electrical wires 408 extend from the power steering control module 338 disposed in the drive unit 12 around the steering actuator 28 to the pump 306. The wires 408 pass through a foam enclosure surrounding the engine 36.

In the illustrated implementation, the power source 450 is in the form of a 12V battery 450, but it is contemplated that the power source 450 could be other than 12V, or other than a battery such as, for example, an alternator.

The controller 342 is connected to the battery 450 via an enable switch 402. The enable switch 402 is an electronic switch in communication with the EMM 404. The EMM 404 controls the enable switch 402 to be selectively open when the engine 36 is turned on and closed when the engine 36 is turned off.

The power connect switch 440 is an electronic switch that allows or interrupts power supply to the motor 306. When in a closed configuration, the power connect switch 440 allows power to be supplied to the motor 306. The power connect switch 440 interrupts power supply to the motor 306 when in an open configuration. The power connect switch 440 is in communication with the controller 342. The controller 342 controls the power connect switch 440 to remain open when the enable switch 402 is open. Thus, the motor 306 is powered only if the engine 36 is powered or activated. The power connect switch 440 therefore prevents sparks when the motor 306 is connected to the power supply 450.

The reverse battery protection switch 430 is an electronic switch in communication with the controller 342 to be controlled thereby. The reverse battery protection switch 430 is configured to be in an open configuration when the battery 450 is connected in a reverse configuration, i.e. with a reverse polarity. It is contemplated that the reverse battery protection switch 430 could be a mechanical switch instead of an electronic switch as in the illustrated implementation.

The PWM switch 420 regulates the duty cycle of the motor 306, thereby regulating the power provided to the motor 306 for operating the pump 302, and the amount of steering assistance provided for steering. The PWM switch 420 is in communication with the controller 342 to receive a control signal therefrom. The controller 342 controls the PWM switch 420 based on information received from the communication circuitry 406 and the temperature $T_{motor}$ of the motor 306 as will be described below in further detail.

The control module 338 also includes a thermal unit 410, including two thermal elements 412, for indicating the temperature of the motor 306. It is contemplated that the number of thermal elements 412 in the thermal unit 410 could be one or more than two. The thermal unit 410 is disposed in the drive unit 12. In the illustrated implementation, each thermal element 412 is a thermistor 412, and the thermal unit 410 is therefore referred to hereinafter as a thermistor unit 410. It should however be understood that one or more of the thermal elements 412 could be other than a thermistor. The thermistors 412 are positive temperature coefficient-type thermistors that function as temperature-sensitive resettable fuses. When the temperature of the thermistors 412 rises above a threshold temperature, current can no longer pass therethrough. It can be said therefore that the thermistors 412 will "open" at the threshold temperature. The thermistors 412 will "close" when the temperature has returned to below the threshold temperature.

In the illustrated implementation, the thermistor unit 410 is connected in series with the motor drive 344. The thermistor unit 410 includes two thermistors 412 in parallel connection with each other such that a portion of the current flowing through the motor 306 flows through each thermistor 412. In the illustrated implementation, the thermistors 412 are identical to each other and as such, only one of the thermistors 412 will be described below. It is contemplated that the thermistor unit 410 could include a single thermistor 412 or more than two thermistors 412. It is contemplated that the thermistors 412 could be different from each other. It is contemplated that, in implementations with two or more thermistors 412, the thermistors 412 could all be connected in parallel with one another, or some of the thermistors 412 could be connected in series with some of the other thermistors 412.

During operation of the power steering system 400, the electric current that powers the motor 306 flows from the battery 450 and through the thermistor unit 410. Within the thermistor unit 410, that current is split equally between the two thermistors 412. The electric current flowing through the thermistor unit 410 and the motor 306 varies as a function of time in response to steering of the watercraft. The temperature $T_{thermistor}$ of the thermistors 412 varies as a result of the electric current flowing therethrough.

The pump 302 is operated based on the demands of the operator of the watercraft steering the watercraft. The temperature $T_{motor}$ of the motor 306 powering the pump 302 may accordingly rise as the watercraft is steered. For example, if the watercraft is being steered aggressively and continuously for a period of time, the motor 306 heats up more than if the watercraft is steered aggressively for a short period of time, or if the watercraft is steered gently. Since the electric current flowing through the thermistor 412 is the electric current flowing through the motor 306, the thermistor temperature $T_{thermistor}$ generally varies in the same way as the temperature $T_{motor}$ of the motor 306. The thermistors 412 are selected to have a threshold temperature (the temperature at which they will "open") below a maximum operating temperature of the motor 306, thereby protecting the motor 306 from overheating. The thermistor temperature $T_{thermistor}$ is thus indicative of the temperature $T_{motor}$ of the motor 306.

Figure 20A:
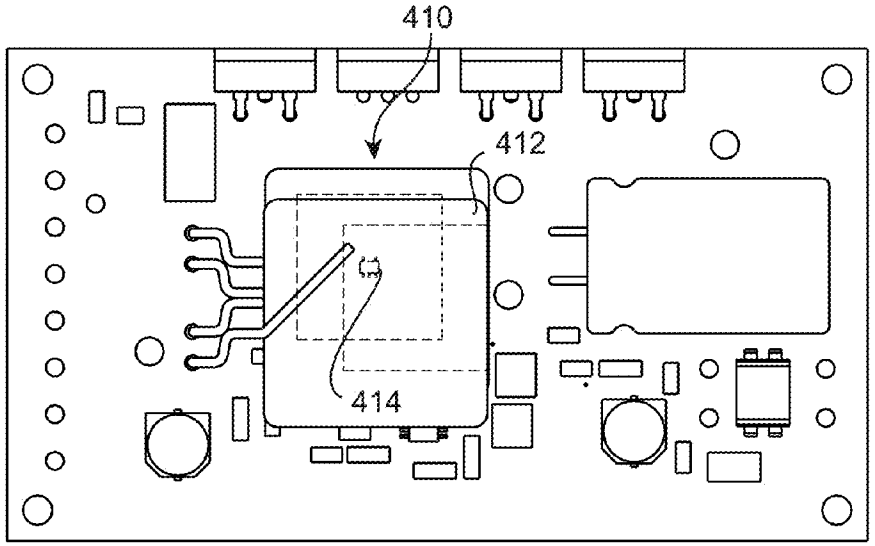
FIG. 20A is a plan view of a printed circuit board (PCB) of the power steering control module of FIG. 17 shown in isolation and including a thermistor unit and a temperature sensor.
Figure 20B:
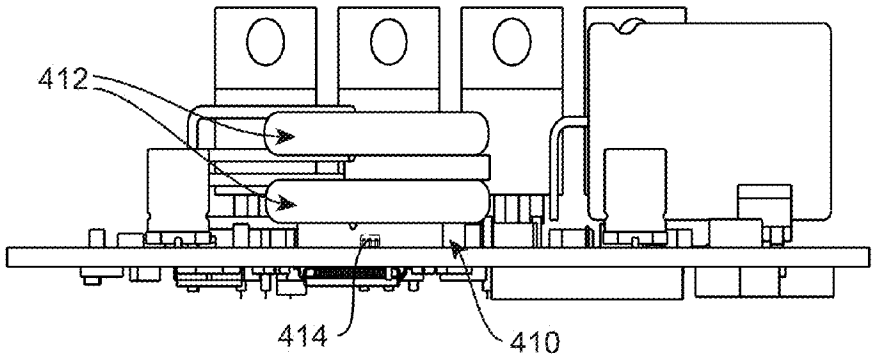
FIG. 20B is an elevation view of the PCB of FIG. 20A.

The control module 338 also includes a temperature sensor 414 mounted adjacent the thermistor unit 410 to sense the temperature $T_{thermistor}$ of at least one of the thermistors 412. In the illustrated implementation, the temperature sensor 414 is a precision analog output CMOS integrated-circuit temperature sensor (LM20 2.4V, 10 μA, SC70, DSBGA temperature sensor manufactured by Texas Instruments™), but it is contemplated that other suitable temperature sensors could be used. In the illustrated implementation, there is a single temperature sensor 414 disposed in proximity to one of the thermistors 414 without being in physical contact therewith as can be seen in FIGS. 20A and 20B. The thermistors 412 and the temperature sensor 414 are mounted on a printed circuit board such that the thermistors 412 are disposed parallel to each other without being in physical contact with each other. The temperature sensor 414 is disposed on one side of one of the thermistors 412. The distance separating the thermistors 412 from the temperature sensor 414 would depend on the particular kind of temperature sensor 414 being used. It is contemplated that the temperature sensor 414 could be mounted in physical contact with one or both of the thermistors 412. It is also contemplated that there could be two temperature sensors 414, one for sensing the temperature of each of the thermistors 412.

The controller 342 is in communication with the temperature sensor 414 for obtaining the thermistor temperature $T_{thermistor}$ and controlling the PWM switch 420 based in part on the thermistor temperature $T_{thermistor}$. As mentioned above, the controller 342 also communicates with the communication circuitry 406 and the EMM 404 for receiving information related to the engine 36 such as the engine speed, and other such parameters related to the operation of the engine 36. The operation of the motor 306 is thus also based partly on the information received by the controller 342 from the communication circuitry 406 and the EMM 404.

As the thermal unit 410 is disposed in the drive unit 12, the temperature sensor 414 is also disposed in the drive unit 12, thus reducing the number of wires (for power and communication) that have to be connected between the control module 338 in the drive unit 12 and the bracket assembly 14".

It is further contemplated that the motor drive 344 or the thermal unit 410 could be configured to be in an open configuration, thereby interrupting the circuit for delivery of power from the power source 450 to the motor 306, when the electric current flowing through the thermal unit 410 exceeds a threshold electric current. For example, the thermal unit 410 or the motor drive 344 could have an electrical fuse or circuit breaker that is configured to open when the electric current exceeds a threshold current.

Figure 16:
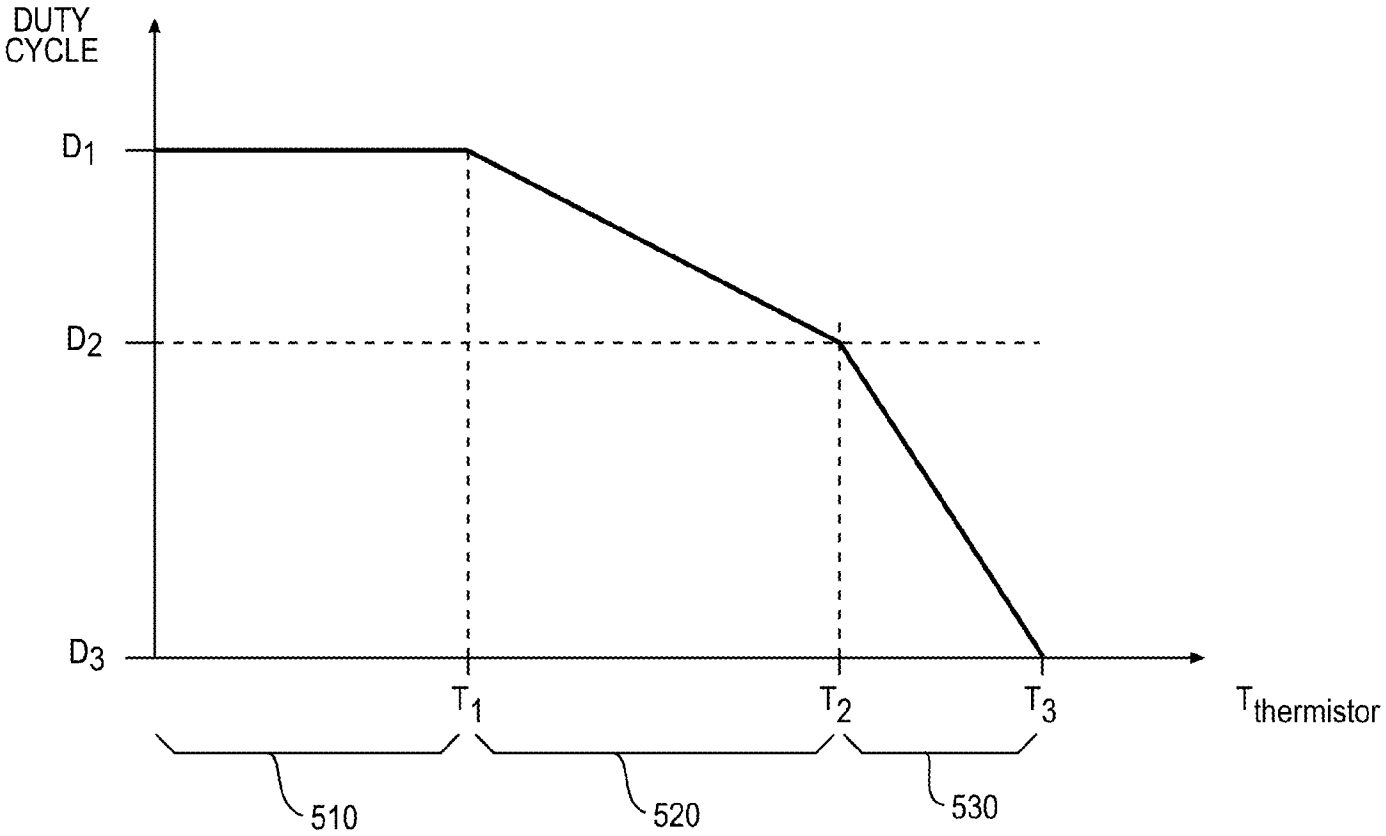
FIG. 16 is a graph illustrating a method of controlling the power steering system of FIG. 15 based on a temperature of a motor for actuating a motor of a hydraulic unit of the power steering system of FIG. 15.

A method of controlling the operation of the motor 306 based on the thermistor temperature $T_{thermistor}$ will now be described with respect to FIG. 16.

In the illustrated implementation, the operation of the motor 306 is controlled based on three different temperature ranges 510, 520 and 530. The first temperature range 510 is for thermistor temperatures $T_{thermistor}$ lower than a first temperature threshold $T_1$. The second temperature range 520 is for thermistor temperatures $T_{thermistor}$ greater than the first temperature threshold $T_1$ and lower than a second temperature threshold $T_2$. The third temperature range 530 is for temperatures $T_{thermistor}$ greater than the second temperature threshold $T_2$ and lower than a third temperature threshold $T_3$. At the third temperature threshold $T_3$, the duty cycle of the motor 306 is reduced to 0% or the motor 306 is shut off. In the illustrated implementation, the first temperature threshold $T_1$ is 58° C., the second temperature threshold $T_2$ is 62° C., and the third temperature threshold $T_3$ is 68° C., but it is contemplated that the values of any one of the temperature thresholds $T_1$, $T_2$, $T_3$ could be greater or smaller than as provided herein. It is also contemplated that there could be two or more than three temperature ranges for controlling the duty cycle of the motor 306 before the motor 306 is shut off.

The method of controlling operation of the motor 306 will be described with respect to a first duty cycle $D_1$ (the duty cycle of the motor 306 at the first temperature threshold $T_1$), a second duty cycle $D_2$ (the duty cycle of the motor 306 at the second temperature threshold $T_2$), and a third duty cycle $D_3$ (the duty cycle of the motor 306 at the third temperature threshold $T_3$). As used herein, regulating or controlling a duty cycle of the motor 306 implies operating the motor 306 periodically, and the duty cycle of the motor 306 is the fraction of time in one period that the motor 306 is operating.

In a first temperature range 510, the controller 342 controls the PWM switch 420 to maintain the duty cycle of the motor 306 at the first duty cycle $D_1$. Thus, in the first temperature range, the duty cycle of the motor 306 is constant as a function of temperature $T_{thermistor}$. In the illustrated implementation, the first duty cycle $D_1$ has a value of 100%. It is contemplated that the first duty cycle $D_1$ could be other than 100%. It is also contemplated that the duty cycle of the motor 306 could not be constant as a function of temperature $T_{thermistor}$ in the first temperature range 510.

In a second temperature range 520, the duty cycle of the motor 306 is controlled to be smaller than the first duty cycle $D_1$. In the illustrated implementation, in the second temperature range 520, the duty cycle of the motor 306 is reduced linearly from the first duty cycle $D_1$ to the second duty cycle $D_2$ as a function of increasing temperature $T_{thermistor}$. In the illustrated implementation, the second duty cycle $D_2$ is 65%. It is contemplated that the second duty cycle $D_2$ could be higher or lower than 65%, as long as the second duty cycle $D_2$ is lower than the first duty cycle $D_1$. It is also contemplated that, in the second temperature range 510, the duty cycle of the motor 306 could decrease as a function of increasing temperature $T_{thermistor}$ in a manner other than linearly. For example, the duty cycle of the motor 306 could decrease continuously or discontinuously in a series of discrete steps as a function of increasing temperature $T_{thermistor}$ in the second temperature range 520. It is contemplated that the controller 342 could set the duty cycle of the motor 306 to be a curvilinear function of $T_{thermistor}$. It is also contemplated that the duty cycle of the motor 306 could remain constant at a value lower than the first duty cycle $D_1$ in the second temperature range 520.

In the third temperature range 530, the duty cycle of the motor 306 is controlled to be smaller than the second duty cycle $D_2$. In the illustrated implementation, in the third temperature range 530, the duty cycle of the motor 306 is reduced linearly from the second duty cycle $D_2$ to the third duty cycle $D_3$ as a function of increasing temperature $T_{thermistor}$.

In the illustrated implementation, the third duty cycle $D_3$ is 0%, but it is contemplated that the third duty cycle $D_3$ could be greater than 0% and that the duty cycle of the motor 306 could be reduced to 0% in one or more subsequent temperature ranges.

In the illustrated implementation, in the third temperature range 530, the duty cycle of the motor 306 is controlled to be inversely proportional to the temperature $T_{thermistor}$. It is also contemplated that, in the third temperature range 530, the duty cycle of the motor 306 could be reduced as a function of increasing temperature $T_{thermistor}$ in a manner other than linearly. For example, the duty cycle of the motor 306 could decrease continuously or discontinuously in a series of discrete steps as a function of increasing temperature $T_{thermistor}$ in the third temperature range 530. It is contemplated that the controller 342 could set the duty cycle of the motor 306 to be a curvilinear function of $T_{thermistor}$. It is also contemplated that the duty cycle of the motor 306 could remain constant at a value lower than the second duty cycle $D_2$ in the third temperature range 530. In the illustrated implementation, the first, second and third duty cycles $D_1$, $D_2$ and $D_3$ and the first, second and third temperatures $T_1$, $T_2$, $T_3$ are saved as a look-up table in memory of the controller 342.

In the illustrated implementation, the duty cycle of the motor 306 decreases at a faster rate in the third temperature range 530 than in the second temperature range 520. It is contemplated that the duty cycle of the motor 306 could decrease at a slower rate in the third temperature range 530 than in the second temperature range 520.

It is contemplated that, in addition to controlling the duty cycle of the motor 306, operation of the motor 306 can also be controlled in other ways as a function of temperature $T_{thermistor}$. For example, it is contemplated that the speed of the motor 306 could be limited to a speed limit based on the thermistor temperature $T_{thermistor}$.

It should be understood that although the above description has been provided with respect to a thermistor 412 and a thermistor unit 410, any other type of electrically conductive temperature-sensitive thermal element 412 that is capable of being coupled remotely to the motor 306 via the motor drive 344, and thereby providing an approximation of the temperature $T_{motor}$ of the motor 306 in real-time can be used instead of, or in addition to the thermistors 412, in the thermal unit 410.

In addition, the description above has been provided with respect to a thermal unit 410 that is indicative of the temperature of the motor 306, and is in a series electrical connection with the motor 306. It is however contemplated that the electrical connection between the motor 306 and the thermal unit 410 could be other than as shown herein. For example, the thermal unit 410 could be connected to the motor 306 in parallel such that the electric current flowing through the thermal unit 410 depends on the electric current flowing through the motor 306, but not the same as the electric current flowing through the motor 306. As another example, the thermal unit 410 could be coupled to the motor drive 344 such that the electric current flowing through the thermal unit 410 is indicative of the electric current flowing in the motor drive 344. For example, the thermal unit 410 could be electromagnetically coupled to the motor drive 344 so that changes in electric current in the motor drive cause corresponding changes in electric current flowing through the thermal unit 410.

Although the method for controlling steering has been described above with reference to the bracket assembly 14" in which the steering actuator 28 is actuated by a single pump 302, it should be understood that the method of controlling steering could be applied to a bracket assembly other than the bracket assembly 14" which has more than one steering actuator 28, or more than one pump for actuating the steering actuator 28. For example, the method of controlling steering could be applied to the bracket assembly 14 which has two pumps 104, 106 for actuating the steering actuator 28. In the case when both the pumps 106, 108 are operating simultaneously, each of their respective motors would be connected as described above via a respective motor drive 344 to the controller 342.

Furthermore, even though the method for controlling power steering has been described above in relation to a hydraulic steering actuator 28 and a hydraulic pump 302 for actuating the steering actuator 28, the method is not to be limited to a hydraulic steering actuator and pump. Aspects of the method of controlling the power steering can be applied to steering actuators other than hydraulic actuators, such as a pneumatic actuator, a mechanical actuator and the like.

Modifications and improvements to the above-described implementations of the present technology may become apparent to those skilled in the art. The foregoing description is intended to be exemplary rather than limiting. The scope of the present technology is therefore intended to be limited solely by the scope of the appended claims.

What is claimed is:

1. An outboard engine for a watercraft comprising:

a bracket configured to be mounted to the watercraft;

a drive unit pivotally mounted to the bracket, the drive unit being pivotable about a steering axis with respect to the bracket;

a steering actuator operatively connected to the bracket and the drive unit for pivoting the drive unit with respect to the bracket about the steering axis;

a motor operatively connected to the steering actuator for actuating the steering actuator, the motor being mounted to the bracket and being rotationally fixed with respect to the bracket about the steering axis; and a power steering control module comprising:

a motor drive electrically connected to the motor and configured to be electrically connected to a power source for delivering power to the motor;

an electrically conductive thermal element electrically connected to the motor, a temperature of the thermal element being indicative of a temperature of the motor; and a controller in communication with the motor drive for controlling power delivered to the motor via the motor drive, the controller being configured to obtain the temperature of the thermal element and to control power delivered to the motor based at least in part on the temperature of the thermal element, the controller and the thermal element being mounted to the drive unit and being pivotable with the drive unit about the steering axis.

2. The outboard engine of claim 1, wherein the controller is disposed inside the drive unit.

3. The outboard engine of claim 1, wherein the thermal element is disposed inside the drive unit.

4. The outboard engine of claim 1, wherein the motor drive is disposed inside the drive unit.

5. The outboard engine of claim 1, wherein the power steering control module is disposed inside the drive unit.

6. The outboard engine of claim 1, wherein the thermal element is connected in series with the motor drive and the motor such that an electric current flowing through the thermal element flows to the motor.

7. The outboard engine of claim 1, wherein the thermal element comprises at least one thermistor.

8. The outboard engine of claim 7, wherein the at least one thermistor is two thermistors in parallel electrical connection with each other.

9. The outboard engine of claim 1, wherein the power steering control module further comprises a temperature sensor configured to sense the temperature of the thermal element, the controller being communicatively linked to the temperature sensor to obtain the sensed temperature of the thermal element.

10. The outboard engine of claim 9, wherein the temperature sensor is disposed in one of: proximity to and contact with the thermal element.

11. The outboard engine of claim 10, wherein the thermal element, the temperature sensor and the controller are disposed inside the drive unit.

12. The outboard engine of claim 11, wherein the motor drive further comprises a pulse width modulation (PWM) switch connected in series with the motor, the controller being communicatively linked to the PWM switch for regulating a duty cycle of the motor.

13. The outboard engine of claim 6, wherein the thermal element is configured to be in an open configuration preventing delivery of power from the power source to the motor when the temperature of the thermal element is higher than an upper threshold temperature.

14. The outboard engine of claim 1, wherein the motor drive further comprises a power connect switch connected in series with the motor and selectively disposed in one of an open configuration and a closed configuration, the closed configuration of the power connect switch allowing power from the power source to be delivered to the motor and the open configuration of the power connect switch preventing power from the power source to be delivered to the motor.

15. The outboard engine of claim 14, wherein the controller is communicatively linked to the power connect switch for disposing the power connect switch in one of the open and closed configurations.

16. The outboard engine of claim 1, wherein the motor drive further comprises a reverse battery protection switch connected in series with the motor, the reverse battery protection switch being in an open configuration when the power source is connected to the motor in a reversed polarity and the reverse battery protection switch being in a closed configuration when the power source is connected to the motor in a correct polarity.

17. The outboard engine of claim 1, wherein the steering actuator is a hydraulic steering actuator and the outboard engine further comprises:

a hydraulic pump operatively connected to the motor and the hydraulic steering actuator;

a passage fluidly connected to at least one of the hydraulic pump and the hydraulic steering actuator; and a pressure sensor mounted to the bracket and configured to sense a pressure of fluid in the passage, the controller being communicatively linked to the pressure sensor for controlling the motor based at least in part on the pressure sensed by the pressure sensor.

18. The outboard engine of claim 1, wherein the outboard engine further comprises a steering position sensor mounted to one of the bracket and the drive unit and configured to sense a position of the drive unit relative to the bracket about the steering axis, the controller being communicatively linked to the steering position sensor for controlling the motor based at least in part on the position sensed by the steering position sensor.

19. A method of controlling power steering of an outboard engine on a watercraft, the outboard engine comprising a bracket mounted to the watercraft and a drive unit pivotably connected to the bracket about a steering axis, the method comprising:

providing electrical power to a motor for actuating a steering actuator of the outboard engine, the motor being mounted to the bracket and rotationally fixed with respect to the bracket about the steering axis;

sensing a temperature of a thermal element electrically connected to the motor, the thermal element being fixed with respect to the drive unit, the sensed temperature of the thermal element being indicative of a temperature of the motor; and controlling a duty cycle of the motor based at least in part on the sensed temperature of the thermal element, and controlling the duty cycle of the motor comprising:

controlling the duty cycle to be a first duty cycle when the sensed temperature of the thermal element is one of lower than a first threshold temperature and the first threshold temperature;

controlling the duty cycle to be smaller than the first duty cycle when the sensed temperature of the thermal element is higher than the first threshold temperature by decreasing the duty cycle at a first rate as a function of increasing sensed temperature when the sensed temperature of the thermal element is higher than the first threshold temperature and lower than a second threshold temperature;

controlling the duty cycle to be a second duty cycle when the sensed temperature of the thermal element is the second threshold temperature, the second duty cycle being lower than the first duty cycle; and controlling the duty cycle to be smaller than the second duty cycle when the sensed temperature of the thermal element is higher than the second threshold temperature by decreasing the duty cycle at a second rate as a function of increasing sensed temperature when the sensed temperature of the thermal element is higher than the second threshold temperature.

* * * * *